US007090951B2

(12) United States Patent
Matsunaga et al.

(10) Patent No.: US 7,090,951 B2
(45) Date of Patent: Aug. 15, 2006

(54) TONER, METHOD FOR FORMING A FULL-COLOR IMAGE, AND PROCESS CARTRIDGE

(75) Inventors: Satoshi Matsunaga, Shizuoka (JP); Atsushi Ishii, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 198 days.

(21) Appl. No.: 10/680,102

(22) Filed: Oct. 8, 2003

(65) Prior Publication Data

US 2004/0072087 A1 Apr. 15, 2004

(30) Foreign Application Priority Data

Oct. 10, 2002 (JP) ..... 2002-297410
Jan. 30, 2003 (JP) ..... 2003-021803

(51) Int. Cl.
*G03G 13/01* (2006.01)
*G03G 9/08* (2006.01)

(52) U.S. Cl. ..... 430/45; 430/108.1; 430/111.4; 399/262

(58) Field of Classification Search ..... 430/45, 430/108.1, 111.4; 399/262
See application file for complete search history.

(56) References Cited

U.S. PATENT DOCUMENTS 5,135,833 A 8/1992 Matsunaga et al. ..... 430/110
5,298,354 A 3/1994 Matsunaga et al. ..... 430/99
5,605,778 A 2/1997 Onuma et al. ..... 430/110
5,635,325 A 6/1997 Inaba et al. ..... 430/106
5,707,771 A 1/1998 Matsunaga ..... 430/110
5,955,234 A 9/1999 Matsunaga et al. ..... 430/110
6,300,024 B1 10/2001 Yusa et al. ..... 430/45
6,613,490 B1 * 9/2003 Matsunaga et al. ..... 430/109.3

FOREIGN PATENT DOCUMENTS

JP 08-50368 2/1996
JP 08-314300 11/1996
JP 10-39538 2/1998
JP 01-75305 3/2001
JP 02-14488 1/2002
JP 02-14489 1/2002
JP 02-40712 2/2002

* cited by examiner

*Primary Examiner*—John L Goodrow
(74) *Attorney, Agent, or Firm*—Fitzpatrick, Cella, Harper & Scinto

(57) ABSTRACT

There is disclosed a toner which comprises at least a binder resin, a coloring agent, and a wax and in which a deformation amount of the toner ($R_{200}$) at the time of application of a load of 200 g at a temperature of 120° C. is 45% to 75% and in which a deformation amount of the toner ($R_{500}$) at the time of application of a load of 500 g at a temperature of 120° C. is 65% to 85% and in which there is at least one endothermic peak or shoulder in a range at 60 to 120° C. in a DSC curve at the time of temperature rise measured by a differential scanning calorimeter (DSC). By the toner, an offset can be inhibited from being generated in heating/pressurizing/fixing in which an oil for preventing a high-temperature offset is not used or a use amount of the oil is reduced, and an OHP fixed image superior in transparency can be obtained.

26 Claims, 18 Drawing Sheets

TONER, METHOD FOR FORMING A FULL-COLOR IMAGE, AND PROCESS CARTRIDGE

This application claims the right of priority under 35 U.S.C. §119 based on Japanese Patent Application Nos.JP 2002-297410 and JP 2003-021803 which are hereby incorporated by reference herein in their entirety as if fully set forth herein.

BACKGROUND OF THE INVENTION

1. Field of the Invention

The present invention relates to a toner for use in developing a static charge image formed in methods for forming an image such as an electrophotographic method, electrostatic recording method, and electrostatic printing method, and also relates to a method for forming a full-color image using the toner.

2. Description of the Related Art

In recent years, in a full-color copying machine, there has been used: a method in which four photosensitive members and a belt-like transfer member are used, and static charge images formed on the respective photosensitive members are developed using cyan, magenta, yellow, and black toners, and subsequently transferred onto a transfer material conveyed between the photosensitive member and the belt-like transfer member during passing the transfer material straightly to form a full-color image; or a method in which the transfer material is wound around the surface of the transfer member by an electrostatic force or a mechanical function like a gripper, the transfer member is disposed opposite to the photosensitive member, and a step of developing and a step of transferring is carried out four times to obtain a full-color image.

Moreover, for the toner for use in the full-color copying machine, colors of the respective toners are requested to be sufficiently mixed in a step of heating/pressurizing/fixing from viewpoints of enhancement of color reproducibility or transparency of an overhead projector (OHP) image.

Therefore, as the toner for the full-color copying machine, a low molecular weight binder resin, which has a sharp melt property as compared with a toner for a general monochromatic copying machine, has been used. However, with the use of the low molecular weight binder resin, resistance to high-temperature offset sometimes drops, when the toner is molten in the step of heating/pressurizing/fixing.

Even when mold release agents such as a polyethylene wax and polypropylene wax are added to the toner in order to enhance the resistance to high-temperature offset at the time of the fixing, for the toner for full color using the low molecular weight binder resin, the binder resin is completely molten in the step of heating/pressurizing/fixing, and therefore the mold release agent does not sufficiently fulfill its effect. Therefore, it has been difficult to sufficiently reduce high-temperature offset.

In order to reduce the high-temperature offset, coating a fixing roller with an oil is also performed, but with the use of the oil, an oil streak in an image at the time of the fixing sometimes raises a problem.

To solve the problem, a toner and a method for forming an image have been proposed in which toner particles are manufactured by a suspension polymerization method, a wax is contained in the toner particles, and accordingly any fixing oil is not used (e.g., Japanese Patent Application Laid-Open Nos. 8-314300 and 8-50368).

However, when a large amount of wax is contained in the toner, concave/convex portions are easily made in the surface of the fixed image with the toner including the binder resin containing a styrene-acryl resin which is a major component. As a result, permeability of the OHP drops.

Moreover, a large number of toners have been proposed, including: a toner which shows a specific melting behavior in a nip portion of a fixing device (e.g., see Japanese Patent Application Laid-Open No. 10-39538); a toner which has a specific viscoelastic characteristic (e.g., see Japanese Patent Application Laid-Open No. 2001-75305); and a toner which contains a specific wax (e.g., see Japanese Patent Application Laid-Open Nos. 2002-14488, 2002-14489, and 2002-40712). However, with respect to either compatibility between low-temperature fixing property and resistance to high-temperature offset, or the transparency of the OHP fixed image, any sufficiently satisfactory toner has not been proposed yet.

To solve the problem, there has been a demand for a toner which realizes the compatibility between the low-temperature fixing property and resistance to offset in the step of heating/pressurizing/fixing not using any oil for preventing the high-temperature offset or using a reduced use amount of the oil, and which is superior in the transparency of the OHP fixed image.

SUMMARY OF THE INVENTION

An object of the present invention is to provide a toner which solves the above-described problem.

That is, an object of the present invention is to provide a toner which can be fixed without applying a large amount of oil or without applying any oil.

Moreover, an object of the present invention is to provide a toner which is satisfactory in transparency in OHP and in color mixture property of a secondary color and which is broad in color reproduction range.

Furthermore, an object of the present invention is to provide a toner which is superior in low-temperature fixing property and in resistance to high-temperature offset and which is broad in non-offset temperature range.

That is, the present invention is as follows.

The present invention relates to a toner comprising at least a binder resin, a coloring agent, and a wax, wherein (a) a deformation amount of the toner ($R_{200}$) at the time of application of a load of 200 g at a temperature of 120° C. is in a range of 45% to 75%, (b) a deformation amount of the toner ($R_{500}$) at the time of application of a load of 500 g at a temperature of 120° C. is in a range of 65% to 85%, and (c) there is at least one endothermic peak or shoulder in a range of 60 to 120° C. in a DSC curve at the time of temperature rise measured by a differential scanning calorimeter (DSC).

According to the present invention, there can be provided a toner which reduces generation of an offset in heating/pressurizing/fixing not using an oil for preventing a high-temperature offset or using a reduced use amount of the oil and which is superior in transparency of an OHP fixed image.

DETAILED DESCRIPTION OF THE INVENTION

Figure 1:
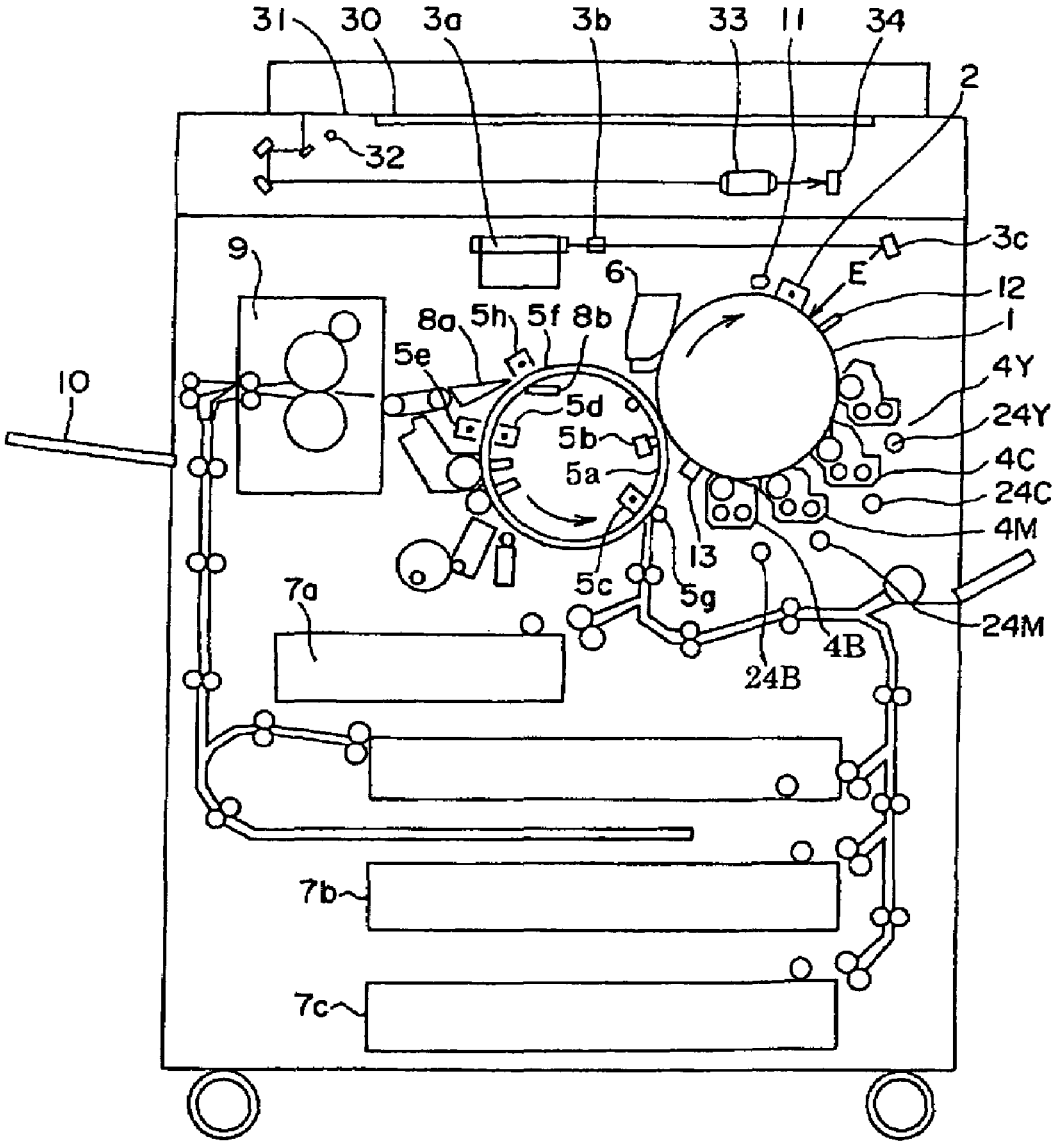
FIG. 1 is a schematically sectional view showing one example of an image forming apparatus in which a toner of the present invention is used.

According to the present invention, there is provided a toner comprising at least a binder resin, a coloring agent, and a wax. A deformation amount of the toner ($R_{200}$) at the time of application of a load of 200 g at a temperature of 120° C. is 45% to 75%, and a deformation amount of the toner ($R_{500}$) at the time of application of a load of 500 g at a temperature of 120° C. is 65% to 85%.

The deformation amount represents a compressed ratio of a sample in the specific load (200 g or 500 g in the present invention) when a compressing force is applied to the sample being heated. The sample is formed by applying pressure to the toner to form the sample having a tablet shape. A detailed measurement method will be described later.

This deformation amount is supposed to be correlated with a fixing property of the toner. It is also supposed that the deformation amount is correlated with a surface property of a fixed image and permeability at the time of the fixing an image onto an OHP sheet.

In the present invention, the deformation amount of the toner ($R_{200}$) is 45 to 75%, preferably 50 to 70%, further preferably 55 to 67%. When the deformation amount of the toner ($R_{200}$) is less than 45%, it is difficult to enhance uniformity of gloss of the fixed image, and transparency of an OHP image has a tendency to drop. When the deformation amount of the toner ($R_{200}$) exceeds 75%, the toner is excessively molten/deformed, and a non-offset temperature region tends to be narrowed.

Moreover, in the present invention, the deformation amount of the toner ($R_{500}$) is 65% to 85%, preferably 70% to 83%, further preferably 75% to 80%. When the deformation amount of the toner ($R_{500}$) is less than 65%, it is difficult to enhance the uniformity of gloss of the fixed image, and the transparency of the OHP image has a tendency to drop. When the deformation amount of the toner ($R_{500}$) exceeds 85%, the toner is excessively molten/deformed, and the non-offset temperature region tends to be narrowed.

In the present invention, a ratio ($R_{500}/R_{200}$) of the deformation amount of the toner ($R_{200}$) to the deformation amount of the toner ($R_{500}$) is preferably 1.10 to 1.50, more preferably 1.15 to 1.45, further preferably 1.20 to 1.40. When the ratio ($R_{500}/R_{200}$) is less than 1.10, the transparency of the fixed image of the OHP sometimes drops. When the ratio ($R_{500}/R_{200}$) exceeds 1.50, it is sometimes difficult to control the gloss of the fixed image.

Moreover, in the toner of the present invention, when the following requirements are satisfied in addition to the above-described requirement, a more preferable toner can be provided.

In the present invention, the toner indicates a mold release load of preferably 20 to 100 g at the temperature of 120° C., more preferably 30 to 80 g, further preferably 40 to 70 g.

For the mold release load, the toner is pressurized to form a tablet-shaped sample, the sample is heated, and a compressing force is applied to the sample to fusion-bond the sample to a parallel plate. Subsequently, the sample is extended, and a record of the force applied until the sample peels off the parallel plate is measured to obtain a value of a resisting force of the sample against the peeling. In the measurement, a maximum value of a resisting force of the sample against the peeling is the mold release load.

Additionally, is represented by a received force corresponding to a weight for pulling the whole of the parallel plate, and a unit of the mold release load is represented by "g". A detailed measurement method will be described later.

The value of the mold release load at 120° C. is correlated with ease of causing an offset phenomenon when a fixed image is peeled from a fixing roller after a toner image is heated/pressurized/fixed onto a transfer material by a fixing roller in a step of fixing. When the mold release load is large, tendencies to have difficulty in peeling the image from the fixing roller and to easily cause an offset are seen.

In the present invention, the wax may have at least one endothermic peak or shoulder in a temperature range of 60 to 120° C. in a DSC curve at the time of temperature rise, measured by a differential scanning calorimeter (DSC). More preferably, the wax may have the endothermic peak or shoulder in a range of 70 to 110° C., more preferably 75 to 100° C.

When the wax does not have at least one endothermic peak or shoulder in a temperature range of 60 to 120° C. in the DSC curve at the time of the temperature rise, measured by the differential scanning calorimeter (DSC), the offset easily occurs regardless of the mold release load of the toner. Moreover, when the offset is inhibited from occurring by coating with the oil, a large amount of oil is sometimes required.

A thermal characteristic of the wax measured by the DSC is substantially the same as a thermal characteristic of the toner measured by the DSC. Therefore, in the present invention, the thermal characteristic of the wax can be said to be similar to that of the toner.

The toner of the present invention has at least one endothermic peak or shoulder in a temperature range of 60 to 120° C., more preferably 70 to 110° C., further preferably 75 to 100° C. in the DSC curve at the time of the temperature rise, measured by the differential scanning calorimeter (DSC).

Furthermore, the toner may preferably indicate the mold release load of 30 to 80 g, and have at least one endothermic peak or shoulder in a temperature range of 70 to 110° C. in the DSC curve at the time of the temperature rise, measured by the differential scanning calorimeter (DSC). The toner may further preferably indicate the mold release load of 40 to 70 g, and have at least one endothermic peak or shoulder in a temperature range of 75 to 100° C. in the DSC curve at the time of the temperature rise, measured by the differential scanning calorimeter (DSC).

When the toner does not have at least one endothermic peak or shoulder in a temperature range of 60 to 120° C. in the DSC curve at the time of the temperature rise, measured by the differential scanning calorimeter (DSC), the offset easily occurs regardless of the mold release load of the toner. When the offset is inhibited from occurring by the coating with the oil, a large amount of oil is sometimes required.

Moreover, when the mold release load is less than 20 g, the toner is hard even at 120° C. in many cases, and it is difficult to satisfy the deformation amount of the toner defined in the present invention. On the other hand, when the mold release load exceeds 100 g, and the wax does not have at least one endothermic peak or shoulder in a temperature range of 60 to 120° C., an adhesive strength between the toner and fixing member becomes excessively strong, and a winding offset sometimes easily occurs. In any case, a large amount of oil is required to prevent the offset.

Next, the binder resin comprised in the toner of the present invention will be described.

The binder resin comprised in the toner of the present invention can be used without being especially limited, as long as the resin can satisfy a range defined with respect to the deformation amount of the toner. For example, it is possible to use resins such as (i) a polyester resin, (ii) a hybrid resin comprising a polyester unit and a vinyl-based polymer unit, (iii) a mixture of the polyester resin and the hybrid resin, (iv) a mixture of the polyester resin and the vinyl-based copolymer, (v) a mixture of the hybrid resin and the vinyl-based copolymer, and (vi) a mixture of the polyester resin, the hybrid resin, and the vinyl-based copolymer. Above all, it is preferable to use the resin containing the hybrid resin including a structure like a graft material. This is because a branched structure of the graft material has a function of enhancing a degree of freedom of deformation, and the deformation amount of the toner is therefore easily controlled in a desired range.

The polyester resin or the polyester unit of the hybrid resin in the binder resin can be used including an alcohol and a carboxylic acid, a carboxylic anhydride, or a carboxylic ester as a material monomer.

Concretely, examples of a bivalent alcohol component include: alkylene oxide adducts such as polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxypropylene (2.0)-polyoxyethylene(2.0)-2,2-bis(4-hydroxyphenyl) propane, and polyoxypropylene(6)-2,2-bis(4-hydroxyphenyl) propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, bisphenol-A, and hydrogenated bisphenol-A.

Examples of a trivalent or more-valued alcohol component include sorbitol, 1,2,3,6-hexane tetrol, 1,4-sorbitan, pentaerythritol, dipentaerythritol, tripentaerythritol, 1,2,4-butanetriol, 1,2,5-pentanetriol, glycerol, 2-methylpropane triol, 2-methyl-1,2,4-butanetriol, trimethylol ethane, trimethylol propane, and 1,3,5-trihydroxymethyl benzene.

Examples of a carboxylic acid component include: aromatic dicarboxylic acids such as a phthalic acid, isophthalic acid, and terephthalic acid or an anhydride thereof; alkyl dicarboxylic acids such as a succinic acid, adipic acid, sebacic acid, and azelaic acid or an anhydride thereof; a succinic acid substituted by an alkyl group having 6 to 12 carbon atoms, or an anhydride thereof; unsaturated dicarboxylic acids such as a fumaric acid, maleic acid, and citraconic acid, or an anhydride thereof; and multivalent carboxylic acids such as a trimellitic acid and pyromellitic acid.

Especially, a bisphenol derivative represented by the following general formula (1) is used as a diol component, a carboxylic acid component containing a bivalent or more carboxylic acid or an anhydride thereof, or lower alkyl ester thereof (e.g., fumaric acid, maleic acid, maleic anhydride, phthalic acid, terephthalic acid, trimellitic acid, pyromellitic acid) is used as an acid component, and these components are subjected to condensation polymerization. An obtained polyester resin preferably has a satisfactory electrostatic charge characteristic as a color toner.

(1)

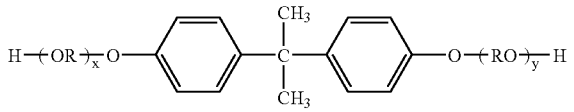

(Wherein R denotes an ethylene or propylene group, x, y are integers of 1 or more, respectively, and an average value of x+y is 2 to 10.)

In the binder resin contained in the toner of the present invention, the "hybrid resin" means a resin in which a vinyl-based polymer unit and polyester unit are chemically bonded. For example, the polyester unit and the vinyl-based polymer unit in which a monomer including a carboxylic ester group such as a (meth)acrylic ester is polymerized, or the polyester unit and the vinyl-based polymer unit in which a monomer including a carboxylic acid group such as a (meth)acrylic acid is polymerized, are subjected to transesterification or condensation polymerization reaction so that the hybrid resin can be formed. As another method, in a component constituting the vinyl-based polymer unit and/or the polyester unit, a monomer component capable of reacting with both the components of the resin is preferably used to manufacture the hybrid resin.

The presence of the hybrid resin can be confirmed by $^{13}$C-NMR measurement. At the time of the $^{13}$C-NMR measurement, with a magnetic toner, resolution of a $^{13}$C-NMR spectrum is inhibited by a magnetic material. Therefore, the toner is added to an aqueous solution of a concentrated hydrochloric acid and stirred at room temperature for 70 to 80 hours to dissolve the magnetic material, and this is used as a measurement sample. As the measurement sample, a nonmagnetic toner containing carbon black or organic pigment can be used as such. Table 1 shows one example of a $^{13}$C-NMR measurement result in a case in which a styrene-acrylic ester copolymer is used as the vinyl-based polymer and/or the resin including an aliphatic dicarboxylic acid unit as a polyester resin is used.

TABLE 1

| | Newly detected signal | Signal of carboxyl group of aliphatic dicarboxylic acid | | Signal of carboxyl group of acrylic ester |
|---|---|---|---|---|
| | about 168 ppm | about 172 ppm | about 174 ppm | about 176 ppm |
| Polyester | — | ○ | ○ | — |
| Vinyl-based polymer | — | — | — | ○ |
| Hybrid resin | ○ | ○ | ○ | ○ |

In the toner of the present invention, examples of a vinyl-based monomer for producing the vinyl-based polymer unit of the hybrid resin component include: styrene; styrene derivatives such as o-methyl styrene, m-methyl styrene, p-methyl styrene, α-methyl styrene, p-phenyl styrene, p-ethyl styrene, 1,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-chlorostyrene, 3,4-dichlorostyrene, m-nitrostyrene, o-nitrostyrene, and p-nitrostyrene; unsaturated mono-olefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic mono-carboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethyl amino ethyl methacrylate, and diethyl amino ethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinyl pyrrole, N-vinyl carbazole, N-vinyl indole, and N-vinyl pyrrolidone; vinyl naphthalenes; and acrylic acids or methacrylic derivatives such as acrylonitrile, methacrylonitrile, and acrylamide.

Furthermore, there are included: unsaturated dibasic acids such as a maleic acid, citraconic acid, itaconic acid, alkenyl succinic acid, fumaric acid, and mesaconic acid; anhydrides of unsaturated dibasic acids such as a maleic anhydride, citraconic anhydride, itaconic anhydride, and alkenyl succinic anhydride; half esters of unsaturated dibasic acids such as a maleic methyl half ester, maleic ethyl half ester, maleic butyl half ester, citraconic methyl half ester, citraconic ethyl half ester, citraconic butyl half ester, itaconic methyl half ester, alkenyl succinic methyl half ester, fumaric methyl half ester, and mesaconic methyl half ester; esters of unsaturated dibasic acids such as a dimethyl maleate and dimethyl fumarate; α, β-unsaturated acids such as an acrylic acid, methacrylic acid, crotonic acid, and cinnamic acid; α, β-unsaturated acid anhydrides such as a crotonic anhydride and cinnamic anhydride, and anhydrides of α, β-unsaturated acids and lower fatty acid; and monomers including carboxylic group such as an alkenyl malonic acid, alkenyl glutaric acid, and alkenyl adipic acid, anhydrides of these, and monoesters of these.

Furthermore, there are included: esters of acrylic acids or methacrylic acids such as 2-hydroxyethyl acrylate, 2-hydroxyethyl methacrylate, and 2-hydroxypropyl methacrylate; and monomers which has hydroxy groups such as 4-(1-hydroxy-1-methylbutyl)styrene and 4-(1-hydroxy-1-methylhexyl)styrene.

The vinyl-based polymer unit in the hybrid resin according to the present invention may also include a cross-linked structure cross-linked by a cross-linking agent including two or more vinyl groups. Examples of the cross-linking agent for use in this case include the followings.

Examples of an aromatic divinyl compound include divinyl benzene and divinyl naphthalene. Examples of diacrylate compounds bonded by alkyl chains include ethylene glycol diacrylate, 1,3-butylene glycol diacrylate, 1,4-butane diol diacrylate, 1,5-pentane diol diacrylate, 1,6-hexane diol diacrylate, neopentyl glycol diacrylate, and a compound whose acrylate is replaced with methacrylate. Examples of diacrylate compounds bonded by alkyl chains including ether bond include diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and a compound whose acrylate is replaced with methacrylate. Examples of diacrylate compounds bonded by chains including aromatic group and ether bond include polyoxyethylene(2)-2,2-bis(4-hydroxyphenyl)propane diacrylate, polyoxyethylene(4)-2,2-bis(4-hydroxyphenyl)propane diacrylate, and a compound whose acrylate is replaced with methacrylate.

Examples of a multifunctional cross-linking agent include: pentaerythritol triacrylate, trimethylol ethane triacrylate, trimethylol propane triacrylate, tetramethylol methane tetraacrylate, oligo ester acrylate, and a compound whose acrylate is replaced with methacrylate; triaryl cyanurate; and triaryl trimellitate.

The components constituting the vinyl-based polymer unit and/or the polyester unit preferably include the monomer component capable of reacting with the components of the resins one another. Examples of the monomer constituting the polyester resin unit and being capable of reacting with the vinyl-based polymer include unsaturated dicarboxylic acids such as a fumaric acid, maleic acid, citraconic acid, and itaconic acid or the anhydride thereof. Examples of the monomer constituting the vinyl-based copolymer component and being capable of reacting with the polyester component include a monomer include a carboxylic or hydroxy group, and an acrylic or methacrylic ester.

A molecular weight adjustment agent may also be used in order to adjust a molecular weight distribution of the vinyl-based polymer unit in the present invention. Examples of the molecular weight adjustment agent include mercaptans generally represented by the following general formula (2), α-methylstyrene, α-methylstyrene dimer, and α-methylstyrene oligomer.

R–SH (R: alkyl group) (2)

As a method for obtaining a reaction product of the vinyl-based polymer unit and polyester resin, a method is preferable in which in the presence of the polymer containing the monomer component being capable of reacting with each of the vinyl-based resin and polyester resin, subjecting to polymerization reaction of either or both of the resins for obtaining the reaction product.

Examples of a polymerization initiator for use in manufacturing the vinyl-based polymer unit of the present invention include: 2,2'-azobisisobutyronitrile, 2,2'-azobis(4-methoxy-2,4-dimethylvaleronitrile), 2,2'-azobis(-2,4-dimethylvaleronitrile), 2,2'-azobis(-2-methylbutyronitrile), dimethyl-2,2'-azobisisobutylate, 1,1'-azobis(1-cyclohexane carbonitrile), 2-(carbamoyl azo)-isobutyronitrile, 2,2'-azobis (2,4,4-trimethyl pentane), 2-phenyl azo-2,4-dimethyl-4-methoxyvaleronitrile, 2,2'-azobis(2-methyl-propane), ketone peroxides such as methyl ethyl ketone peroxide, acetyl acetone peroxide, and cyclohexanone peroxide, 2,2-bis(t-butyl peroxy)butane, t-butyl hydroperoxide, cumene hydroperoxide, 1,1,3,3-tetramethyl butyl hydroperoxide, di-t-butyl peroxide, t-butyl cumyl peroxide, di-cumyl peroxide, α,α'-bis(t-butyl peroxyisopropyl)benzene, isobutyl peroxide, octanoyl peroxide, decanoyl peroxide, lauroyl peroxide, 3,5,5-trimethyl hexanoyl peroxide, benzoyl peroxide, m-trioyl peroxide, di-isopropyl peroxydicarbonate, di-2-ethyl hexyl peroxydicarbonate, di-n-propyl peroxydicarbonate, di-2-ethyoxy ethyl peroxycarbonate, di-methoxyisopropyl peroxydicarbonate, di(3-methyl-3-methoxybutyl) peroxycarbonate, acetylcyclohexyl sulfonyl peroxide, t-butyl peroxyacetate, t-butyl peroxyisobutylate, t-butyl peroxyneodecanoate, t-butyl peroxy-2-ethyl hexanoate, t-butyl peroxylaurate, t-butyl peroxybenzoate, t-butyl peroxyisopropyl carbonate, di-t-butyl peroxyisophthalate, t-butyl peroxyaryl carbonate, t-amyl peroxy-2-ethyl hexanoate, di-t-butyl peroxyhexahydroterephthalate, and di-t-butyl peroxyazelate.

Next, an example of a method for manufacturing the hybrid resin for use in the binder resin of the present invention. For example, the hybrid resin of the present invention can be manufactured in the following manufacturing methods (1) to (6).

(1) This is a method of manufacturing and subsequently blending a vinyl-based resin, polyester resin, and hybrid resin. The blend is dissolved/swollen in an organic solvent (e.g., xylene), removed the organic solvent, and manufactured. It is to be noted that an ester compound can be used as a hybrid resin component. The ester compound is synthesized by being dissolved/swollen the vinyl-based polymer and polyester resin, separately manufactured, in a small amount of the organic solvent; adding an esterified catalyst and alcohol; and heating these to carry out transesterification.

(2) This is a method of manufacturing the vinyl-based polymer unit and subsequently manufacturing the polyester unit and hybrid resin in the presence of the vinyl-based polymer unit. The hybrid resin component is manufactured by reaction of the vinyl-based polymer unit (a vinyl-based monomer may also be added if necessary) and polyester monomer (alcohol, carboxylic acid) and/or polyester. The organic solvent can also appropriately be used in this case.

(3) This is a method of manufacturing the polyester unit and manufacturing the vinyl-based polymer unit and hybrid resin in the presence of the polyester unit. The hybrid resin is manufactured by the reaction of the polyester unit (the polyester monomer may also be added if necessary) and the vinyl-based monomer and/or the vinyl-based polymer unit.

(4) After manufacturing the vinyl-based polymer unit and polyester unit, the vinyl-based monomer and/or the polyester monomer (alcohol, carboxylic acid) are/is added in the presence of these polymer units to manufacture the hybrid resin. The organic solvent may also appropriately be used in this case.

(5) After manufacturing the hybrid resin, and adding the vinyl-based monomer and/or the polyester monomer (alcohol, carboxylic acid), addition polymerization and/or condensation polymerization are/is carried out to manufacture the vinyl-based polymer and/or polyester. In this case, the hybrid resin manufactured by the manufacturing methods (2) to (4) can also be used, and the hybrid resin manufactured by a known manufacturing method can also be used if necessary. Furthermore, the organic solvent can appropriately be used.

(6) When the vinyl-based monomer and polyester monomer (alcohol, carboxylic acid, and the like) are mixed to continuously carry out the addition polymerization and condensation polymerization, the vinyl-based polymer unit, polyester unit, and hybrid resin are manufactured. Furthermore, the organic solvent can appropriately be used.

A plurality of polymer units having a plurality of different molecular weights and degrees of crosslinking can be used as the vinyl-based polymer unit and/or the polyester unit in the above manufacturing methods (1) to (5).

In the toner of the present invention, a ratio (vinyl-based polymer unit/polyester unit) of the vinyl-based polymer unit to the polyester unit of the hybrid resin is 1.5 or less, preferably 1.0 or less, more preferably 0.8 or less in accordance with mass conversion. When the ratio (vinyl-based polymer unit/polyester unit) exceeds 1.5, the deformation amount of the toner tends to decrease, and OHP permeability tends to be deteriorated.

The toner of the present invention may contain a tetrahydrofuran (THF) insoluble component by 1 to 30 mass %, preferably 2 to 25 mass %, further preferably 5 to 20 mass % on a total resin component basis. When the THF insoluble component is less than 1 mass %, a mold release strength of the toner tends to decrease. When the THF insoluble component exceeds 30 mass %, the deformation amount of the toner is excessively reduced, and tends to be difficult to control the deformation amount of the toner.

Moreover, for the toner of the present invention, the tetrahydrofuran (THF) soluble component of the toner has a peak in a region of molecular weights 3000 to 20000 in chromatogram by gel permeation chromatography (GPC) measurement, and a ratio (Mw/Mn) of a weight-average molecular weight (Mw) to a number-average molecular weight (Mn) is preferably 5 to 300.

In a more preferable case, there is a peak in a region of molecular weights 5000 to 15000, and the ratio (Mw/Mn) is 10 to 100. In a further preferable case, there is a peak in a region of molecular weights 7000 to 13000, and ratio (Mw/Mn) is 15 to 50, and especially the ratio (Mw/Mn) is 15 to 30.

Either when there is not the peak in the region of the molecular weights 3000 to 15000 or when the ratio (Mw/Mn) is less than 5 or exceeds 300, it is difficult to control the deformation amount of the toner.

The wax contained in the toner of the present invention is preferably any one selected from a paraffin wax, Fischer-Tropsch wax, polyethylene-based wax, and a wax obtained by introducing a hydroxyl group into the wax, and is more preferably the paraffin wax, Fischer-Tropsch wax, or polyethylene-based wax.

For the wax, a main peak molecular weight (Mp) manufactured by the GPC is preferably 300 to 2000, and the ratio (Mw/Mn) is 1.0 to 10. More preferably, Mp is 500 to 1500, and the ratio (Mw/Mn) is 1.1 to 5. Further preferably, Mp is 600 to 1000, and the ratio (Mw/Mn) is 1.2 to 4.

When Mp is less than 300, a dispersed particle diameter of the wax in toner particles becomes excessively small. Conversely, either when Mp exceeds 2000 or when the ratio (Mw/Mn) exceeds 10, the dispersed particle diameter becomes excessively large. In any case, it is difficult to control the dispersed particle diameter of the wax, and a large amount of oil is sometimes required for preventing a high-temperature offset.

Moreover, the toner of the present invention preferably has an acid value of 30 mgKOH/g or less, more preferably has an acid value of 5 to 25 mgKOH/g, and further preferably has an acid value of 10 to 20 mgKOH/g.

When the acid value exceeds 30 mgKOH/g, it becomes difficult to hold a dispersed state of the wax contained in the toner particles at the time of the fixing in a state preferable for the toner of the present invention, and the large amount of oil is sometimes required for preventing the high-temperature offset.

Moreover, for the toner of the present invention, the weight-average particle diameter is preferably 4.0 to 10.0 μm, more preferably 5.0 to 8.0 μm, further preferably 5.7 to 7.0 μm.

Furthermore, for a particle size distribution of the toner of the present invention, particles having a particle diameter of 10.2 μm or more is preferably less than 50% by volume, more preferably less than 30% by volume, further preferably less than 10% by volume.

When the weight-average particle diameter of the toner is less than 4.0 μm, charging stabilization drops, and fogging or toner scattering tends to occur. When the weight-average particle diameter of the toner exceeds 10.0 μm, reproducibility of a half tone portion sometimes drops.

Moreover, in the toner of the present invention, an average circularity of particles having a diameter of 3 μm or more is 0.950 or more, and it is preferable to contain the particles, having a circularity of 0.950 or more, by 70% or more by number. More preferably, the average circularity is 0.955 or more, and the particles having a circularity of 0.950 or more are contained by 75% or more by number. Further preferably, the average circularity is 0.960 or more, and the particles having a circularity of 0.950 or more are contained by 80% or more by number.

When the average circularity is less than 0.950, and a ratio of particles having a circularity of 0.950 or more is less than 70% by number, a transfer property of the toner is not improved, and a laminate state of the toner particles transferred onto a transfer material easily becomes non-uniform. During the fixing in this state, problems such as the scattering of the toner particles, non-uniform gloss, a drop of the OHP permeability easily occur.

For the toner of the present invention, for a purpose of controlling a charging characteristic of the toner, organic metal compounds can also be added. The organic metal compounds are preferably metal compounds of aromatic carboxylic acid derivatives selected from the group of compounds consisting of aromatic oxycarboxylic acids and aromatic alkoxycarboxylic acids.

For the metal, bivalent or more-valued metal atoms are preferable. Examples of the bivalent metal include $Mg^{2+}$, $Ca^{2+}$, $Sr^{2+}$, $Pb^{2+}$, $Fe^{2+}$, $Co^{2+}$, $Ni^{2+}$, $Zn^{2+}$, $Zr^{2+}$, and $Cu^{2+}$. Above all, as the bivalent metal, $Zn^{2+}$, $Ca^{2+}$, $Mg^{2+}$, $Zr^{2+}$, and $Sr^{2+}$ are preferable. Examples of trivalent or more-valued metals include $Al^{3+}$, $Cr^{3+}$, $Fe^{3+}$, and $Ni^{3+}$. Above all, $Al^{3+}$ and $Cr^{3+}$ are preferable, and $Al^{3+}$ is especially preferable.

As a concrete example of the organic metal compound, an aluminum compound of 3,5-di-tert-butylsalicylic acid is especially preferable.

Moreover, in a method for manufacturing the metal compound of the aromatic carboxylic acid derivative selected from the aromatic oxycarboxylic acid and aromatic alkoxycarboxylic acid, for example, an oxycarboxylic acid and alkoxycarboxylic acid is dissolved in an aqueous solution of sodium hydroxide, and an aqueous solution including dissolved bivalent or more-valued metal atoms is dropped into the aqueous solution of sodium hydroxide, and heated/stirred. Next, pH of the aqueous solution is adjusted, cooled to room temperature, and thereafter filtered/rinsed so that the compound can be synthesized. Additionally, the method is not limited to this synthesis method.

In the toner of the present invention, the organic metal compound is preferably added by 0.1 to 5 parts by mass with respect to 100 parts by mass of the binder resin of the toner, more preferably added by 0.1 to 1 parts by mass, and further preferably added by 0.15 to 0.8 parts by mass. When an addition amount exceeds 5 parts by mass, it is sometimes difficult to control the deformation amount of the toner.

The toner of the present invention is allowed to contain a magnetic material, and can also be used as a magnetic toner. In this case, the magnetic material may also have a function of a coloring agent. Examples of the magnetic material include: iron oxides such as magnetite, maghemite, and ferrite, and iron oxides including other metal oxides; and metals such as Fe, Co, Ni, alloys of these metals with metals such as Al, Co, Cu, Pb, Mg, Ni, Sn, Zn, Sb, Be, Bi, Cd, Ca, Mn, Se, Ti, W, V, and mixtures of these.

For the magnetic material, preferably the number-average particle diameter is 0.1 to 2 μm (more preferably 0.1 to 0.5 μm), a magnetic characteristic at application of 795.8 kA/m (10 k oersteads) corresponds to a coercive force of 1.6 to 12.0 kA/m, saturation magnetization is 50 to 200 $Am^2/kg$ (preferably 50 to 100 $Am^2/kg$), and residual magnetization is 2 to 20 $Am^2/kg$.

When the toner of the present invention is used as a magnetic one-component-based developer carried on a developer carrier comprising a magnet with magnetic binding strength, it is preferable to contain 5 to 120 parts by mass of the magnetic material with respect to 100 parts by mass of the binder resin of the toner.

Moreover, when the toner is used as a one-component developer carried on the developer carrier including no magnet without any magnetic binding strength, it is preferable to contain 0.1 to 4 parts by mass of the magnetic material with respect to 100 parts by mass of the binder resin of the toner. When the magnetic material is contained in this range, toner scattering phenomenon at the time of endurance (in-machine dirt) can be suppressed. When the content of the magnetic material exceeds 5 parts by mass, the surface of a regulating blade or an elastic roller carrying the toner is remarkably broken (shaved), and this is a cause for a charging defect.

Furthermore, when the toner is mixed with magnetic carrier particles and used as a two-components developer, a mixture ratio as a concentration of the toner in the developer is 2 to 15% by mass, preferably 3 to 13% by mass, more preferably 4 to 10% by mass, and in this case a satisfactory result is generally obtained. When the magnetic carrier particles are mixed with the toner in the present invention to prepare the two-components developer, and when the toner concentration is less than 2% by mass, image density easily lowers. When the toner concentration exceeds 15% by mass, the fogging or in-machine scattering easily occurs, and life of the developer tends to shorten.

Next, the coloring agent to be contained in the toner of the present invention will be described.

For the coloring agent for use in the present invention, a pigment and/or a dye can be used. The pigment may also be used alone, but with combined use of the dye with the pigment, clarity is preferably enhanced. This is more preferable, because an image quality can be improved especially at the time of formation of a full-color image.

Examples of the dye include: C.I. direct red 1; C.I. direct red 4; C.I. acid red 1; C.I. basic red 1; C.I. mordant red 30; C.I. direct blue 1; C.I. direct blue 2; C.I. acid blue 9; C.I. acid blue 15; C.I. basic blue 3; C.I. basic blue 5; C.I. mordant blue 7; C.I. direct green 6; C.I. basic green 4; and C.I. basic green 6.

Examples of the pigment include: mineral fast yellow; navel yellow; naphthol yellow S; Hansa yellow G; permanent yellow NCG; tartrazine lake; molybdenum orange; permanent orange GTR; pyrazolone orange; benzidine orange G; permanent red 4R; watching red calcium salt; eosin lake; brilliant carmine 3B; manganese purple; fast violet B; methyl violet lake; cobalt blue; alkali blue lake; Victoria blue lake; phthalocyanine blue; fast sky blue; Indanthrene blue BC; chrome green; pigment green B; malachite green lake; and final yellow green G.

Moreover, with the use as the toner for forming the full-color image, examples of a coloring pigment for magenta include: C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, 238; C.I. pigment violet 19; and C.I. vat red 1, 2, 10, 13, 15, 23, 29, 35.

Examples of the dye for magenta include: oil-soluble dyes such as C.I. solvent red 1, 3, 8, 23, 24, 25, 27, 30, 49, 81, 82, 83, 84, 100, 109, 121, C.I. disperse red 9, C.I. solvent violet 8, 13, 14, 21, 27, and C.I. disperse violet 1; and basic dyes such as C.I. basic red 1, 2, 9, 12, 13, 14, 15, 17, 18, 22, 23, 24, 27, 29, 32, 34, 35, 36, 37, 38, 39, 40, and C.I. basic violet 1, 3, 7, 10, 14, 15, 21, 25, 26, 27, 28.

Examples of the coloring pigment for cyan include: C.I. pigment blue 2, 3, 15, 16, 17; C.I. acid blue 6; C.I. acid blue 45; and a copper phthalocyanine pigment in which one to five phthalimide methyl groups are bonded to a phthalocyanine skeleton.

Examples of the coloring pigment for yellow include: C.I. pigment yellow 1, 2, 3, 4, 5, 6, 7, 10, 11, 12, 13, 14, 15, 16, 17, 23, 65, 73, 83, 93, 97, 180; and C.I. vat yellow 1, 3, 20.

As the coloring agent for black, carbon black or an agent toned in black using the above-described coloring agents may be used.

For a use amount, with respect to 100 parts by mass of the binder resin, the coloring agent is contained by preferably 1 to 15 parts by mass, more preferably 3 to 12 parts by mass, further preferably 4 to 10 parts by mass.

When the content of the coloring agent is larger than 15 parts by mass, the transparency drops. Additionally, reproducibility of a neutral color represented by a human flesh color easily drops. Furthermore, the stability of the charging property of the toner drops, and a targeted charging amount is not easily obtained. When the content of the coloring agent is smaller than 1 part by mass, a coloring force drops, and a high-grade image having a high image density is not easily obtained.

Moreover, the toner of the present invention more preferably contains a fluidity improving agent for improving an image quality.

Any fluidity improving agent can be used as long as the fluidity can increase after the addition to the toner as compared with before the addition. Examples of the fluidity improving agent include: fluorine-based resin powders such as a vinylidene fluoride fine powder and polytetrafluoroethylene fine powder; silica fine powders such as silica fine powders by wet and dry manufacturing methods, and treated silica powders such as the silica fine powders subjected to a surface treatment by treatment agents such as a silane coupling agent, titanium coupling agent, and silicone oil; a titanium oxide fine powder; an alumina fine powder; a treated titanium oxide fine powder; and a treated alumina fine powder.

The fluidity improving agent produces a satisfactory result, when a specific surface area is 30 $m^2/g$ or more, preferably 50 $m^2/g$ or more by nitrogen adsorption measured by a BET method. With respect to 100 parts by mass of the toner, the fluidity improving agent may be contained by 0.01 to 8 parts by mass, preferably by 0.1 to 4 parts by mass.

When the fluidity improving agent is sufficiently mixed with the toner by mixers such as Henschel mixer, it is possible to obtain the toner including the fluidity improving agent in the surfaces of the toner particles.

It is to be noted that when the toner of the present invention contains the above-described components other than the binder resin, coloring agent, and wax, such as the organic metal compound and fluidity improving agent, the measurement of the deformation amount of the toner defined in the present invention is also carried out with respect to the toner containing the other components.

<Method for Manufacturing Toner of the Invention>

Hereinafter, a preferable method for manufacturing the toner of the present invention will be described.

A concrete method for manufacturing the toner of the present invention will be described with reference to FIG. 3.

First, a mixture containing at least the binder resin, wax, and coloring agent is molten/kneaded, an obtained kneaded material is cooled, and subsequently a cooled material is coarsely pulverized by a pulverizing means.

A powder raw material including the obtained coarsely pulverized material is introduced into a first determining supply machine. A predetermined amount of the powder raw material from the first determining supply machine is introduced into a mechanical pulverizer (pulverizing means) via a powder material inlet. The pulverizer comprises a rotor constituted of at least a rotary member attached to a center rotation shaft, and a stator disposed around the rotor holding a constant interval from the surface of the rotor. The pulverizer is constituted so as to have an airtight state in an annular space formed by the held interval between the rotor and stator. The rotor of the mechanical pulverizer is rotated at high speed to finely pulverize the introduced powder raw material.

The finely pulverized material is discharged via a powder material outlet of the mechanical pulverizer, and introduced into a second determining supply machine. A predetermined amount of the finely pulverized material is introduced into a super fractionation air current type classifier (classifying means) which uses intersecting air currents and Coanda effect to air-current classify the powder material from the second determining supply machine, and the finely pulverized material is classified into at least fine, medium, and coarse powders in the super fractionation air current type classifier.

The classified coarse powder is introduced into the mechanical pulverizer together with the powder raw material, and is repeatedly subjected to a step of pulverizing.

In the toner of the present invention, the medium powder obtained using this pulverizing/classifying system is used.

Figure 4:
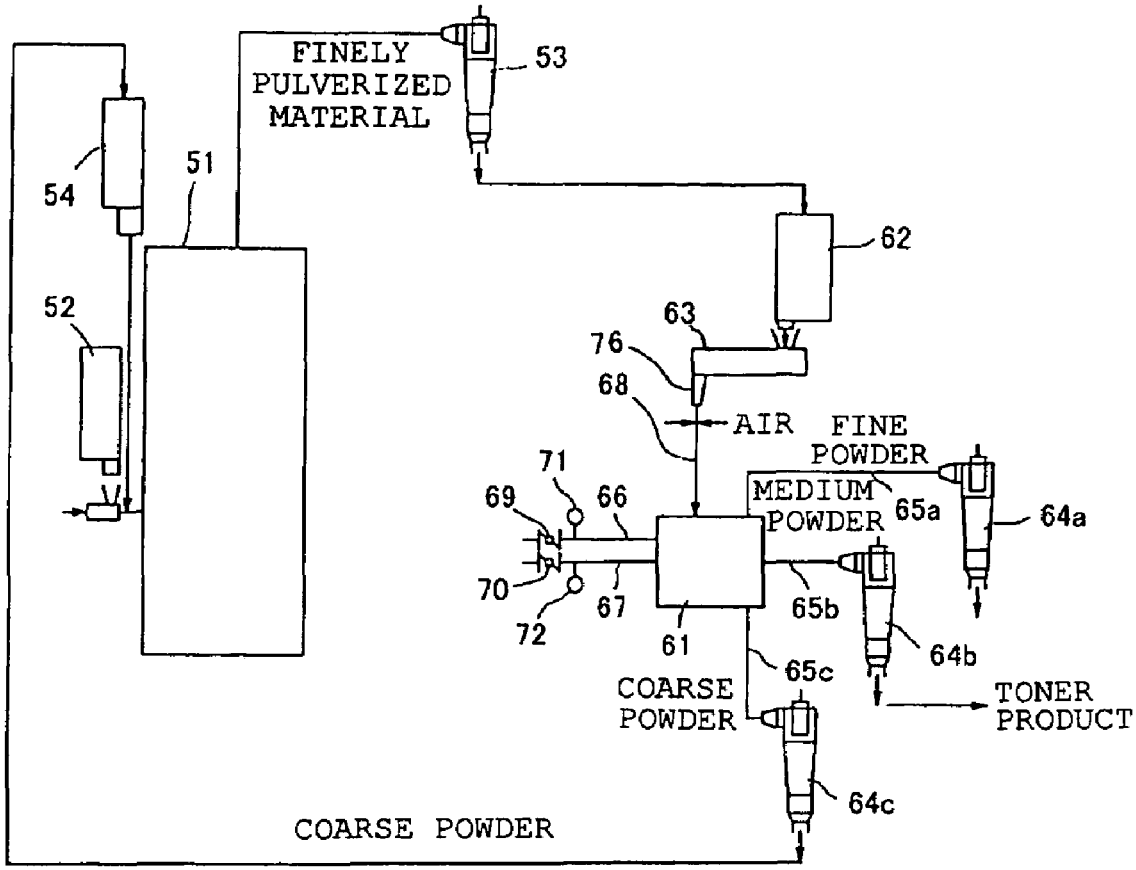
FIG. 4 is a schematic diagram showing one concrete example of an apparatus system for carrying out the method for manufacturing the toner of the present invention.

More concretely, as shown in FIG. 4, the predetermined amount of a coarse powder raw material which is a toner raw material is first introduced into a mechanical pulverizer 51 which is the pulverizing means via a first determining supply machine 52. The introduced powder raw material is momentarily pulverized by the mechanical pulverizer 51, and is introduced into a second determining supply machine 62 via a trapping/collecting cyclone 53. Next, the material is supplied into a super fractionation air current type classifier 61 which is classifying means via a vibration feeder 63 and further via a raw material supply nozzle 76.

Moreover, in this apparatus system, for a relation between the predetermined amount introduced into the mechanical pulverizer 51 which is the pulverizing means from the first determining supply machine 52 and the predetermined amount introduced into the super fractionation air current type classifier 61 which is the classifying means from the second determining supply machine 62, assuming that the predetermined amount introduced into the mechanical pulverizer 51 from the first determining supply machine 52 is 1, the predetermined amount introduced into the super fractionation air current type classifier 61 from the second determining supply machine 62 is 0.7 to 1.7, more preferably 0.7 to 1.5, further preferably 1.0 to 1.2. This is preferable from viewpoints of toner productivity and production efficiency.

Usually for the air current type classifier, apparatuses are connected to each other by a communicating means such as a pipe, and incorporated and used in the apparatus system. In FIG. 4, in this manner, the super fractionation air current type classifier 61 (classifying apparatus shown in FIG. 8), determining supply machine 62, vibration feeder 63, and trapping/collecting cyclones 64*a* to 64*c* are connected to one another by the communicating means to constitute an integral apparatus.

In this apparatus system, the powder is supplied into the second determining supply machine 62 by appropriate means, and is next introduced into the super fractionation air current type classifier 61 via the vibration feeder 63 by the raw material supply nozzle 76.

In the introduction, the powder is introduced into the super fractionation air current type classifier 61 at a flow rate 10 to 350 m/second. Since a size constituting a classifying chamber of the super fractionation air current type classifier 61 is usually (10 to 50 cm)×(10 to 50 cm), the powder can be classified into three or more types of groups of particles momentarily in 0.1 to 0.01 second or less. Moreover, the super fractionation air current type classifier 61 classifies the powder into large particles (coarse particles), medium particles, and small particles.

Thereafter, the large particles are fed to the trapping/collecting cyclone 64*c* via a discharge conduit 65*c*. The medium particles are discharged to the outside of the system via a discharge conduit 65*b*, trapped/collected by the trapping/collecting cyclone 64*b*, and collected so as to constitute the toner.

The small particles are discharged to the outside of the system via a discharge conduit 65*a*, trapped/collected by the trapping/collecting cyclone 64*a*, and supplied and reused in a step of melting/kneading for producing the powder raw material constituted of the toner material, or discarded.

The trapping/collecting cyclones 64*a* to 64*c* can also function as suction/depressurization means for sucking/introducing the powder raw material into the classifying chamber from a supply nozzle 68.

Moreover, the classified large particles are preferably introduced into a supply machine 54, mixed into the powder raw material, and pulverized again in the mechanical pulverizer 51.

Furthermore, a re-introduction amount of large particles (coarse particles) introduced again into the mechanical pulverizer 51 from the super fractionation air current type classifier 61 is 0 to 10.0% by mass, preferably 0 to 5.0% by mass on the basis of the mass of the finely pulverized material supplied from the second determining supply machine 62. This is preferable for toner productivity.

When the re-introduction amount of large particles (coarse particles) introduced again into the mechanical pulverizer 51 from the super fractionation air current type classifier 61 exceeds 10.0% by mass, powder dust concentration in the mechanical pulverizer 51 increases, and a load of the apparatus itself increases. Additionally, the material is excessively pulverized at the time of the pulverizing, and change of properties of the surface of the toner or in-machine fusion bond by heat easily occurs. This is unfavorable for the toner productivity.

In this apparatus system, for the particle size of the powder raw material, 18-mesh-pass (ASTM E-11-61) preferably indicates 95% or more by mass, and 100-mesh-on (ASTM E-11-61) indicates 90% or more by mass.

Moreover, in this apparatus system, in order to obtain the toner having a sharp particle size distribution in which the weight-average particle diameter is 10 μm or less (further 8 μm or less), it is preferable that the weight-average particle diameter of the finely pulverized material finely pulverized by the mechanical pulverizer 51 is in a range of 4 to 10 μm, the diameter of 4.0 μm or less occupies 70% or less by number, further 65% or less by number, the diameter of 10.1 μm or more occupies 25% or less by volume, further 20% or less by volume.

Furthermore, for the particle size of the classified medium powder, it is preferable that the weight-average particle diameter is in a range of 5 to 10 μm, the diameter of 4.0 μm or less occupies 40% or less by number, further 35% or less by number, the diameter of 10.1 μm or more occupies 25% or less by volume, further 20% or less by volume.

In the apparatus system, a step of first classifying before the pulverizing treatment is not required, and the steps of pulverizing and classifying can be carried out by one pass.

The mechanical pulverizer preferably for use as the pulverizing means used in manufacturing the toner of the present invention will be described. Examples of the mechanical pulverizer include pulverizer KTM manufactured by Kawasaki Heavy Industries, Ltd. and a turbo mill manufactured by Turbo Industries, Co., Ltd. These apparatus are preferably used as such, or appropriately modified and used.

Figure 5:
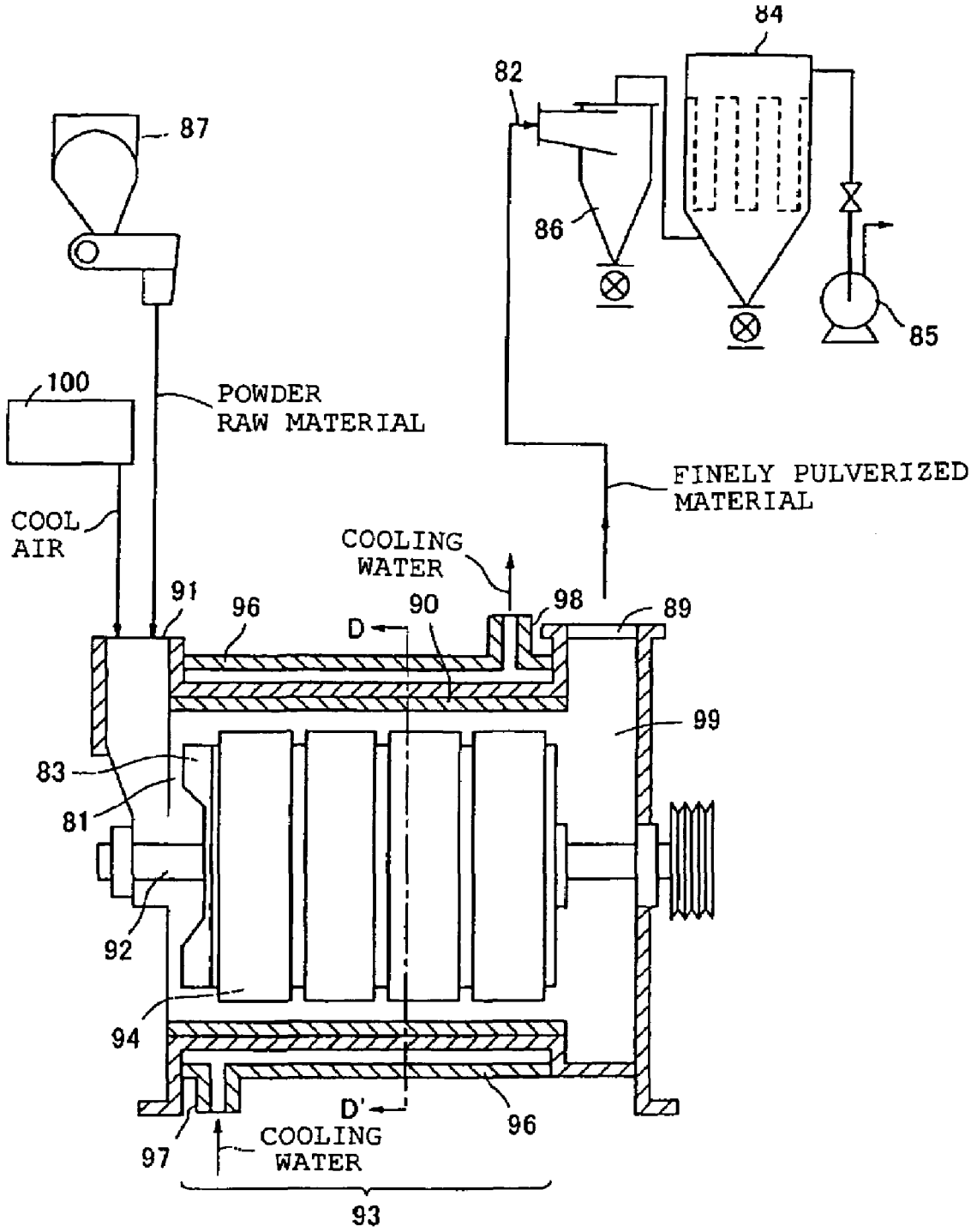
FIG. 5 is a schematically sectional view showing one example of a mechanical pulverizer for use in a step of pulverizing of the toner of the present invention.
Figure 6:
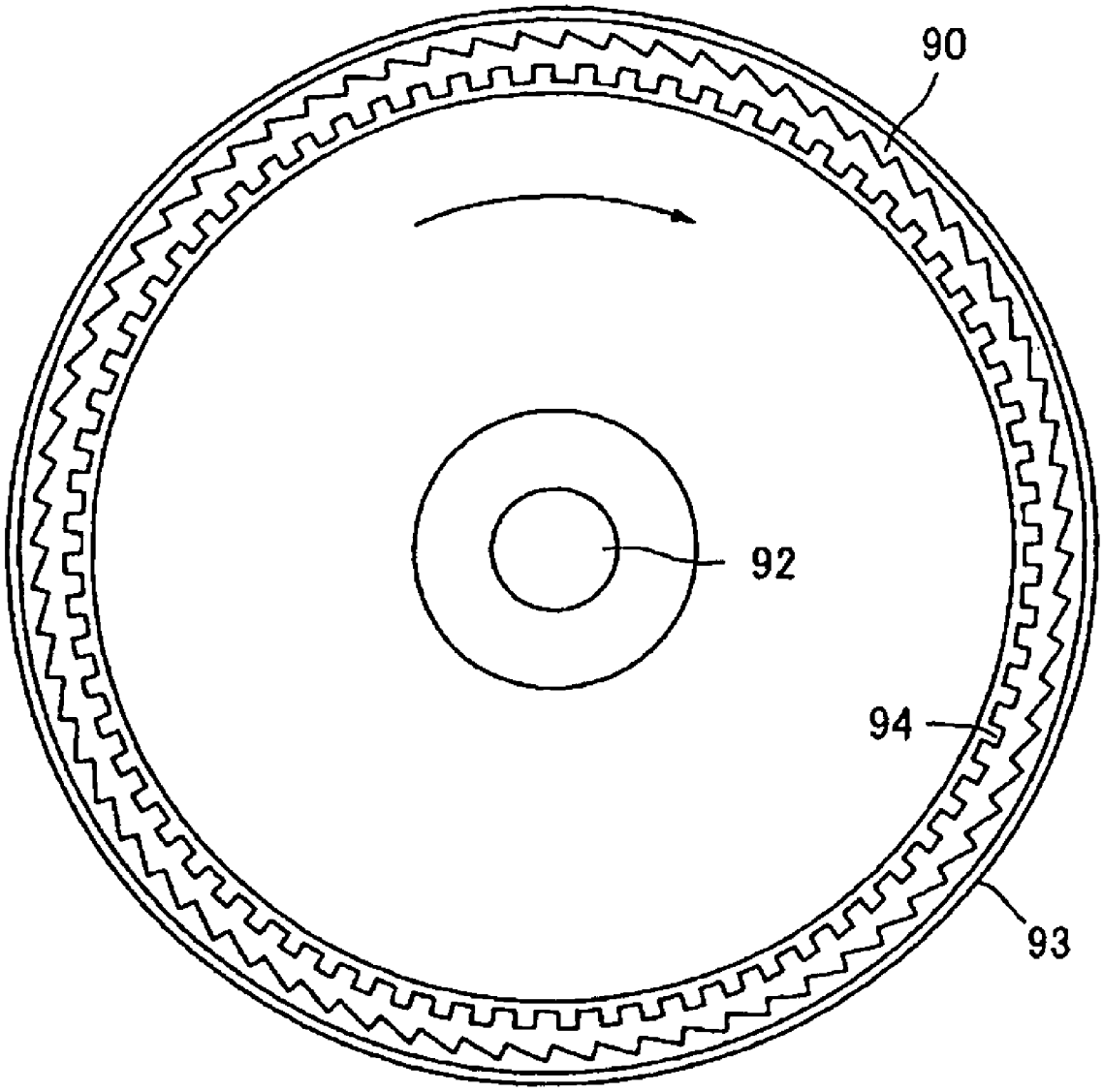
FIG. 6 is a schematic diagram in a plane D–D' in FIG. 5.
Figure 7:
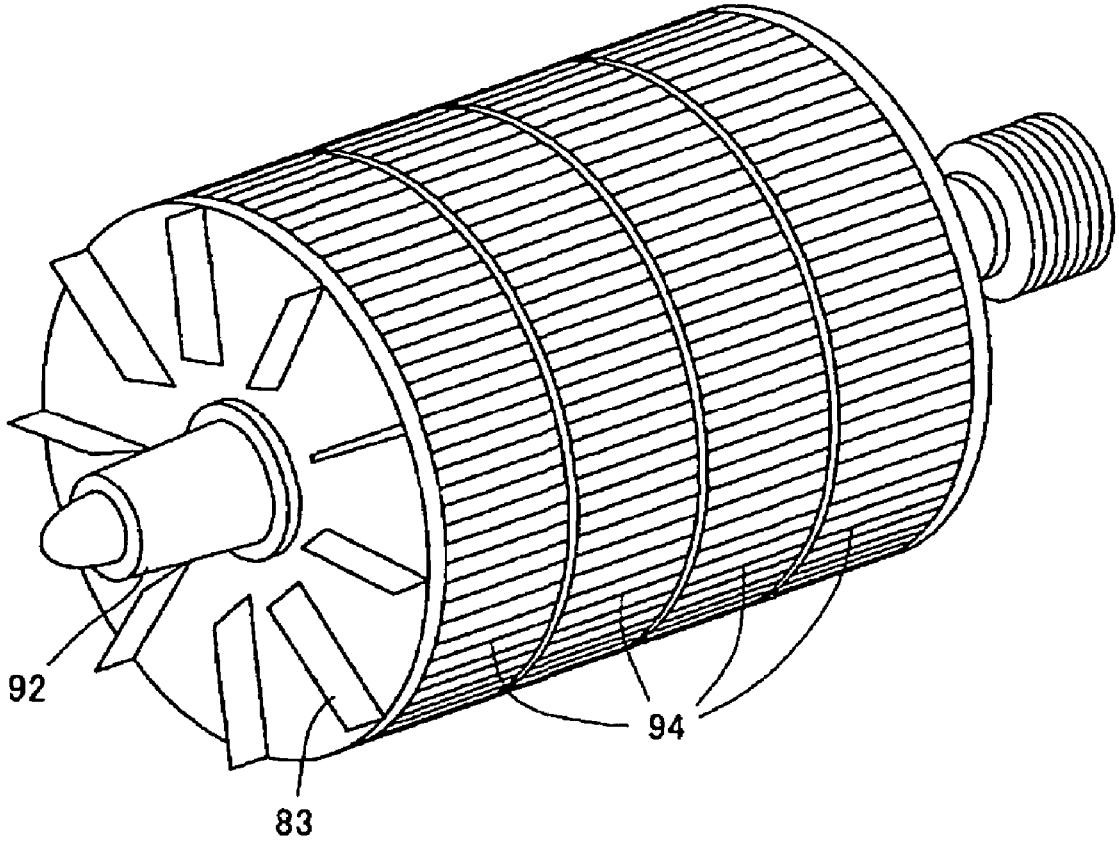
FIG. 7 is a perspective view showing a rotor shown in FIG. 5.

In the present invention, among these, the mechanical pulverizer shown in FIGS. 5, 6, and 7 is preferably used, because the pulverizing treatment of the powder raw material can easily be carried out and therefore the efficiency is improved.

The mechanical pulverizer shown in FIGS. 5, 6, and 7 will hereinafter be described.

FIG. 5 is a schematically sectional view showing one example of the mechanical pulverizer for use in the present invention, FIG. 6 is a schematic sectional view in a plane D–D' in FIG. 5, and FIG. 7 is a perspective view showing rotors 94 shown in FIG. 5. As shown in FIG. 5, the apparatus is constituted of: a casing 93; a jacket 96 including a cooling water supply port 97 and cooling water discharge port 98; a distributor 83; a rotor 94 disposed in the casing 93 and attached to a center rotation shaft 92 and rotating at high speed and including a large number of grooves in the surface; a stator 90 disposed holding a constant interval in an outer periphery of the rotor 94 and including a large number of grooves in the surface; a raw material throw-in port 91 for introducing the raw material to be treated; and a raw material discharge port 89 for discharging the treated powder.

A pulverizing operation in the mechanical pulverizer constituted as described above is carried out, for example, as follows.

That is, when the predetermined amount of the powder raw material is thrown in together with cool air via the raw material throw-in port 91 of the mechanical pulverizer shown in FIG. 5, the particles are introduced into a pulverizing treatment chamber, and momentarily pulverized by an impact generated between the rotor 94 rotating at high speed in the pulverizing treatment chamber and including a large number of grooves disposed in the surface, and the stator 90 including a large number of grooves disposed in the surface, a large number of ultra high-speed eddy currents generated behind the impact, and high-frequency pressure vibration generated by the currents. Thereafter, the material is passed through the raw material discharge port 89 and discharged.

Air conveying the toner particles passes through the raw material discharge port 89 via the pulverizing treatment chamber, a pipe 82, a trapping/collecting cyclone 86, a bug filter 84, and a suction filter 85, and is discharged to the outside of the apparatus system.

Since the powder raw material is pulverized in this manner in the present pulverizer, a desired pulverizing treatment can easily be carried out without increasing the fine and coarse powders. It is to be noted that reference numeral 87 denotes a powder raw material supply machine, and 100 denotes a cool air generator.

Moreover, in the pulverizing of the powder raw material by the mechanical pulverizer, a temperature difference $\Delta T(T_2-T_1)$ between a room temperature $T_1$ of a spiral chamber 81 of the mechanical pulverizer and room temperature $T_2$ of a rear chamber 99 is set to preferably 30 to 80° C., more preferably 35 to 75° C., further preferably 37 to 72° C. This is preferable from the viewpoint of the toner productivity. When $\Delta T$ between the temperature $T_1$ and temperature $T_2$ of the mechanical pulverizer is set to preferably 30 to 80° C., more preferably 35 to 75° C., further preferably 37 to 72° C., the properties of the surface of the toner can be inhibited from being changed by the heat, and the powder raw material can efficiently be pulverized.

When $\Delta T$ between the temperature $T_1$ (inlet temperature) and temperature $T_2$ (outlet temperature) of the mechanical pulverizer is smaller than 30° C., there is a possibility that the material causes a short pass without being pulverized, and this is unfavorable from the viewpoint of a toner capability. When the difference is larger than 80° C., there is a possibility that the material is excessively pulverized at the time of the pulverizing, the surface property change of the toner or the in-machine fusion bond by the heat easily occurs, and this is unfavorable from the viewpoint of the toner productivity.

Moreover, when the powder raw material is pulverized by the mechanical pulverizer, the inlet temperature of the mechanical pulverizer is 0° C. or less, and is set to be lower than a glass transition point (Tg) of the binder resin by 60 to 75° C., and this is preferable from the viewpoint of the toner productivity.

When the inlet temperature of the mechanical pulverizer is set to 0° C. or less and to be lower than Tg by 60 to 75° C., the properties of the surface of the toner can be inhibited from being changed by the heat, and the powder raw material can efficiently be pulverized.

Moreover, it is preferable that the outlet temperature is lower than Tg by 5 to 30° C., preferably 10 to 20° C. When the outlet temperature of the mechanical pulverizer is set to be lower than Tg by 5 to 30° C., the properties of the surface of the toner can be inhibited from being changed by the heat, and the powder raw material can efficiently be pulverized.

Furthermore, a tip-end peripheral speed of the rotating rotor 94 is set to preferably 80 to 180 m/sec, more preferably 90 to 170 m/sec, further preferably 100 to 160 m/sec from the viewpoint of the toner productivity. When the peripheral speed of the rotating rotor 94 is set to the above-described value, insufficient or excessive pulverizing of the toner can be inhibited, and the powder raw material can efficiently be pulverized.

When the peripheral speed of the rotor 94 is lower than 80 m/sec, the material easily causes the short pass without being pulverized, and this is unfavorable from the viewpoint of the toner capability. When the peripheral speed of the rotor 94 is higher than 180 m/sec, the load of the apparatus itself increases. Additionally, at the time of the pulverizing, the material is excessively pulverized, the surface property change and in-machine fusion bond of the toner by the heat easily occur, and this is therefore unfavorable from the viewpoint of the toner productivity.

Moreover, a minimum interval between the rotor 94 and the stator 90 is preferably 0.5 to 10.0 mm, more preferably 1.0 to 5.0 mm, further preferably 1.0 to 3.0 mm. When the interval between the rotor 94 and the stator 90 is set to the above-described value, the insufficient or excessive pulverizing of the toner can be inhibited, and the powder raw material can efficiently be pulverized.

When the interval between the rotor 94 and the stator 90 is larger than 10.0 mm, the material easily causes the short pass without being pulverized, and this is unfavorable from the viewpoint of the toner capability. When the interval between the rotor 94 and the stator 90 is smaller than 0.5 mm, the load of the apparatus itself increases. Additionally, at the time of the pulverizing, the material is excessively pulverized, the surface property change and in-machine fusion bond of the toner by the heat easily occur, and this is therefore unfavorable from the viewpoint of the toner productivity.

The first classification before the step of pulverizing is not required in the above-described method for pulverizing. Therefore, when the toner is formed into fine particles, electrostatic aggregation among the particles is enhanced. Fine and ultrafine powders are not generated obtained by excessive pulverizing, because the toner, to be originally fed into second classifying means, circulates in the first classifying means again. Furthermore, the constitution is simple. Additionally, the constitution does not require a large amount of air for pulverizing the powder raw material. Therefore, power consumption is low, and energy cost can be reduced.

Next, an air current type classifier preferably for use as the classifying means in manufacturing the toner of the present invention will be described.

The apparatus of a type shown in FIG. 8 (sectional view) will be described as one concrete example of the super fractionation air current type classifier preferable as the classifying means.

Figure 8:
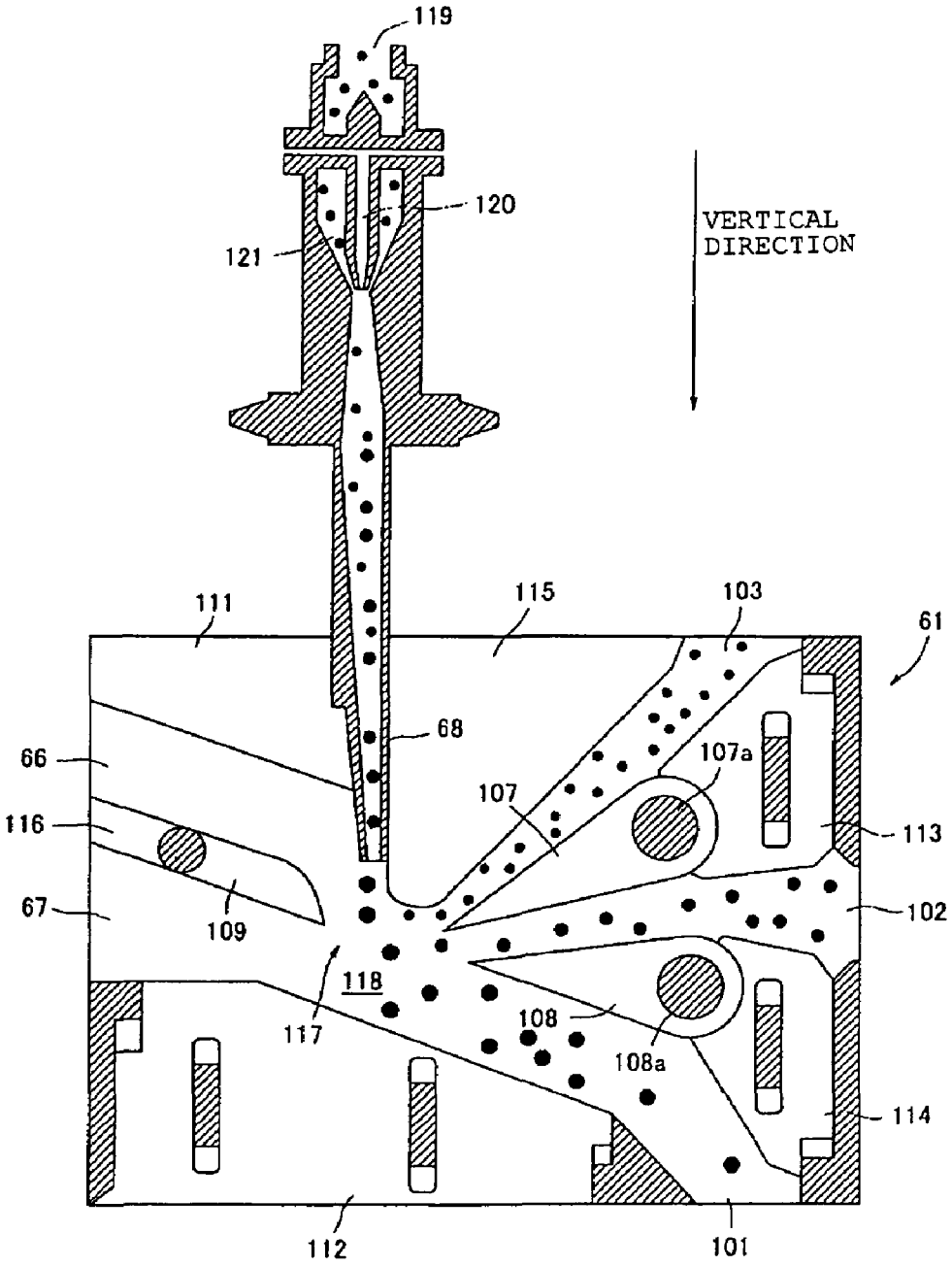
FIG. 8 is a schematically sectional view of a super fractionation air current type classifier for use in a step of classifying of the toner of the present invention.

In FIG. 8, a side wall 111 and G block 112 form a part of the classifying chamber, and classifying edge blocks 113 and 114 include classifying edges 107 and 108. The G block 112 can vertically be slid in an installation position. The classifying edges 107 and 108 can rotate centering on shafts 107*a* and 108*a*. The classifying edges can be rotated to change classifying edge tip-end positions.

The installation positions of the respective classifying edge blocks 113 and 114 can be slid from side to side. Accordingly, the respective knife edge type classifying edges 107 and 108 vertically slide. A classifying region 117 of a classifying chamber 118 is divided/defined into three by the classifying edges 107 and 108.

A raw material supply port 119 for introducing the raw material powder is disposed in a rearmost end of the raw material supply nozzle 68. A high-pressure air supply nozzle 120 and raw material powder introducing nozzle 121 are disposed in a rear end of the raw material supply nozzle 68. The raw material supply nozzle 68 including an opening in the classifying chamber 118 is disposed on the right side of the side wall 111, and a Coanda block 115 is disposed so as to draw an oblong arc with respect to an extension direction of a lower tangent line of the raw material supply nozzle 68.

A left block 116 of the classifying chamber 118 includes a knife edge type directed in a right direction of the classifying chamber 118, and air inlet tubes 66 and 67 opened into the classifying chamber 118 are disposed on the left side of the classifying chamber 118. As shown in FIG. 4, first gas introduction adjustment means 69 and second gas introduction adjustment means 70 such as dampers, and static pressure meters 71 and 72 are disposed in the air inlet tubes 66 and 67.

The positions of the classifying edges 107 and 108, G block 112, and air inlet edge 109 are adjusted by the type and desired particle diameter of the toner which is the raw material classified/treated.

Moreover, outlets 101 to 103 opened into the classifying chamber 118 are disposed opposite to fractionated regions in the upper surface of the classifying chamber 118, and the outlets 101 to 103 are connected to the communicating means such as pipe, and may include open/close means such as valve means.

The raw material supply nozzle 68 is constituted of a right-angled cylindrical portion and a pyramid cylindrical portion. When a ratio of an inner diameter of the right-angled cylindrical portion to that of a narrowest portion of the pyramid cylindrical portion is set to 20:1 to 1:1, preferably 10:1 to 2:1, a satisfactory introduction speed is obtained.

A classifying operation in a super fractionated classifying region as described above is carried out, for example, as follows.

That is, the inside of the classifying chamber 118 is depressurized via at least one of the outlets 101 to 103. The powder is spouted and dispersed into the classifying chamber 118 via the raw material supply nozzle 68 preferably at a flow rate of 10 to 350 m/sec by ejector effects of an air current flowing by the depressurization in the raw material supply nozzle 68 including the opening in the classifying chamber 118 and a compressed air spouted from the high-pressure air supply nozzle 120.

The particles in the powder introduced into the classifying chamber 118 draw a curve and move by a function of the Coanda effect of the Coanda block 115 and a function of a gas such as inflow air. In accordance with the particle diameters of the particles and a size of an inertial force, the large particles (coarse particles) are classified into a first fractionation outside the air current, that is, outside the classifying edge 108, the medium particles are classified into a second fractionation between the classifying edges 108 and 107, and the small particles are classified into a third fractionation inside the classifying edge 107. The classified large particles are discharged. Furthermore, a classifying point is influenced by a suction flow rate of the classifying air current or a jet speed of the powder from the raw material supply nozzle 68.

<Method for forming Full-Color Image using Toner of the Invention>

The toner of the present invention can preferably be used especially in forming a full-color image. A method for forming a full-color image of the present invention and an image forming apparatus for carrying out the method for forming an image will hereinafter be described.

The method for forming an image of the present invention includes:

(i) forming a first static charge image on an image carrier, developing the static charge image with a first toner selected from the group consisting of a cyan toner, magenta toner, and yellow toner to form a first toner image on the image carrier, and transferring the first toner image onto a transfer material via or not via an intermediate transfer member;

(ii) forming a second static charge image on an image carrier, developing the static charge image with a second toner selected from the group consisting of the cyan toner, magenta toner, and yellow toner to form a second toner image on the image carrier, and transferring the second toner image onto the transfer material via or not via the intermediate transfer member;

(iii) forming a third static charge image on an image carrier, developing the static charge image with a third toner selected from the group consisting of the cyan toner, magenta toner, and yellow toner to form a third toner image on the image carrier, and transferring the third toner image onto the transfer material via or not via the intermediate transfer member; and (vi) heating/fixing the first to third toner images on the transfer material to form a full-color image on the transfer material, (v) wherein a toner satisfying provisions of the present invention is used as the cyan toner, magenta toner, and yellow toner.

Moreover, in the method for forming an image of the present invention, a static charge image for black is formed on an image carrier, the static charge image for black is developed with a black toner to form a black toner image on the image carrier, the black toner image is transferred onto the transfer material via or not via the intermediate transfer member, and the black toner image is heated/fixed together with the first to third toner images (cyan, magenta, and yellow toner images) on the transfer material to form the full-color image on the transfer material. In the method for forming an image, the toner satisfying the provisions of the present invention is used as the black toner.

Furthermore, according to the present invention, there is provided an image forming apparatus for transporting and developing a toner onto an electrostatic latent image formed on a photosensitive member to form a toner image, and transferring the toner image onto a transfer material to form an image. As the toner, the toner of the present invention is used.

A method for forming a full-color image using the toner of the present invention will hereinafter be described in more detail with reference to FIG. 1.

FIG. 1 is a schematical constitution diagram showing one example of the image forming apparatus for forming the full-color image by an electrophotographic method.

The image forming apparatus of FIG. 1 is used as a full-color copying machine or a full-color printer. With the full-color copying machine, as shown in FIG. 1, a digital color image reader section is disposed in an upper part, and a digital color image printer section is disposed in a lower part.

In the image reader section, a manuscript 30 is laid on a glass manuscript stage 31, and exposed to/scanned by an exposure lamp 32. Accordingly, a reflected light image from the manuscript 30 is converged into a full-color sensor 34 by a lens 33 to obtain a color separation image signal. The color separation image signal is processed in a video processing unit (not shown) via an amplifier circuit (not shown), and sent to the digital image printer section.

In the image printer section, a photosensitive drum 1 which is the image carrier (also referred to as the photosensitive member in the present invention) includes a photosensitive layer, for example, including an organic photoconductive matter, and is held rotatably in an arrow direction. Around the photosensitive drum 1, there are disposed a pre-exposure lamp 11, a corona charging device 2, a laser exposure optical system 3 (a to c), a potential sensor 12, four developing units 4Y, 4C, 4M, 4B, on-drum light amount detection means 13, a transfer device 5, and a cleaning device 6.

In the laser exposure optical system, an image signal from the reader section is converted into a light signal of image scan exposure in a laser output section (not shown), converted laser light is oscillated from a laser unit 3*a*, and the laser light is projected onto the surface of the photosensitive drum 1 via a lens 3*b* and mirror 3*c*.

In the printer section, at the time of image formation, the photosensitive drum 1 is rotated in the arrow direction, and static electricity is eliminated by the pre-exposure lamp 11. Thereafter, the photosensitive drum 1 is uniformly minus-charged by the charging device 2, a light image E is irradiated for each separated color, and the static charge image is formed on the photosensitive drum 1.

Next, a predetermined developing unit is operated to develop the static charge image on the photosensitive drum 1, and the toner image is formed by the toner on the photosensitive drum 1. By operations of eccentric cams 24Y, 24C, 24M, 24B, one of the developing units 4Y, 4C, 4M, 4B is selectively brought close to the photosensitive drum 1 for each separated color to develop the image.

The transfer device 5 includes: a transfer drum 5*a*; a transfer charging device 5*b*; an adsorption charging device 5*c* for electrostatically adsorbing the transfer material which is a recording material; an adsorption roller 5*g* disposed opposite to the device; an inner charging device 5*d*; an outer charging device 5*e*; and a separation charging device 5*h*. A transfer sheet 5*f* is a transfer material carrier, rotatably/drivably supported by the transfer drum 5*a*, and the sheet is integrally adjusted on a cylinder. Resin films such as a polycarbonate film are used in the transfer sheet 5*f*.

The transfer material is passed through a transfer sheet conveying system from a cassette 7*a*, 7*b*, or 7*c*, conveyed into information transfer drum 5*a*, and held on the transfer drum 5*a*. The transfer material held on the transfer drum 5*a* is repeatedly conveyed into a transfer position which is between the photosensitive drum 1 and the transfer drum 5*a* with the rotation of the transfer drum 5*a*, and the toner image on the photosensitive drum 1 is transferred onto the transfer material by the function of the transfer charging device 5*b* in the process of passing through the transfer position.

The toner image may directly be transferred onto the transfer material from the photosensitive member as shown in FIG. 1. The toner image on the photosensitive member may also be transferred onto the intermediate transfer member, and transferred onto the transfer material from the intermediate transfer member.

The above-described step of forming an image is repeated with respect to yellow (Y), magenta (M), cyan (C), and black (B), and four color toner images are superposed on the transfer material on the transfer drum 5*a* to obtain a color image.

The transfer material onto which the four color toner images are transferred in this manner is separated from the transfer drum 5*a* by the functions of a separation claw 8*a*, a separation push-up roller 8*b*, and the separation charging device 5*h*, sent to a heating/pressurizing/fixing device 9, and heated/pressurized/fixed to mix the colors of the toners, develop the colors, and fix the images onto the transfer material. After forming a full-color fixed image, the sheet is discharged to a tray 10, and the formation of the full-color image ends.

It is to be noted that after transferring the toner image onto the transfer material, the toner remaining on the photosensitive member is removed by the cleaning device 6.

The method for forming an image in which the four color developing units are disposed for one photosensitive member has been described with reference to FIG. 1. However, a method for forming an image of a tandem system may also be used in which the four color developing units are disposed in different photosensitive members, and the toner images formed on each of the photosensitive member are successively transferred onto the transfer material via or not via an intermediate transfer member.

At this time, the fixing operation in the heating/pressurizing/fixing device 9 may be performed at a speed (e.g., 90 mm/sec) lower than a process speed of a main body (e.g., 160 mm/sec). This is because a sufficient heating amount has to be given to the toner in order to melt/color-mix an unfixed image in which two to four layers of toners are stacked. When the fixing is performed at a speed lower than a developing speed, the heating amount for the toner can be increased.

Figure 2:
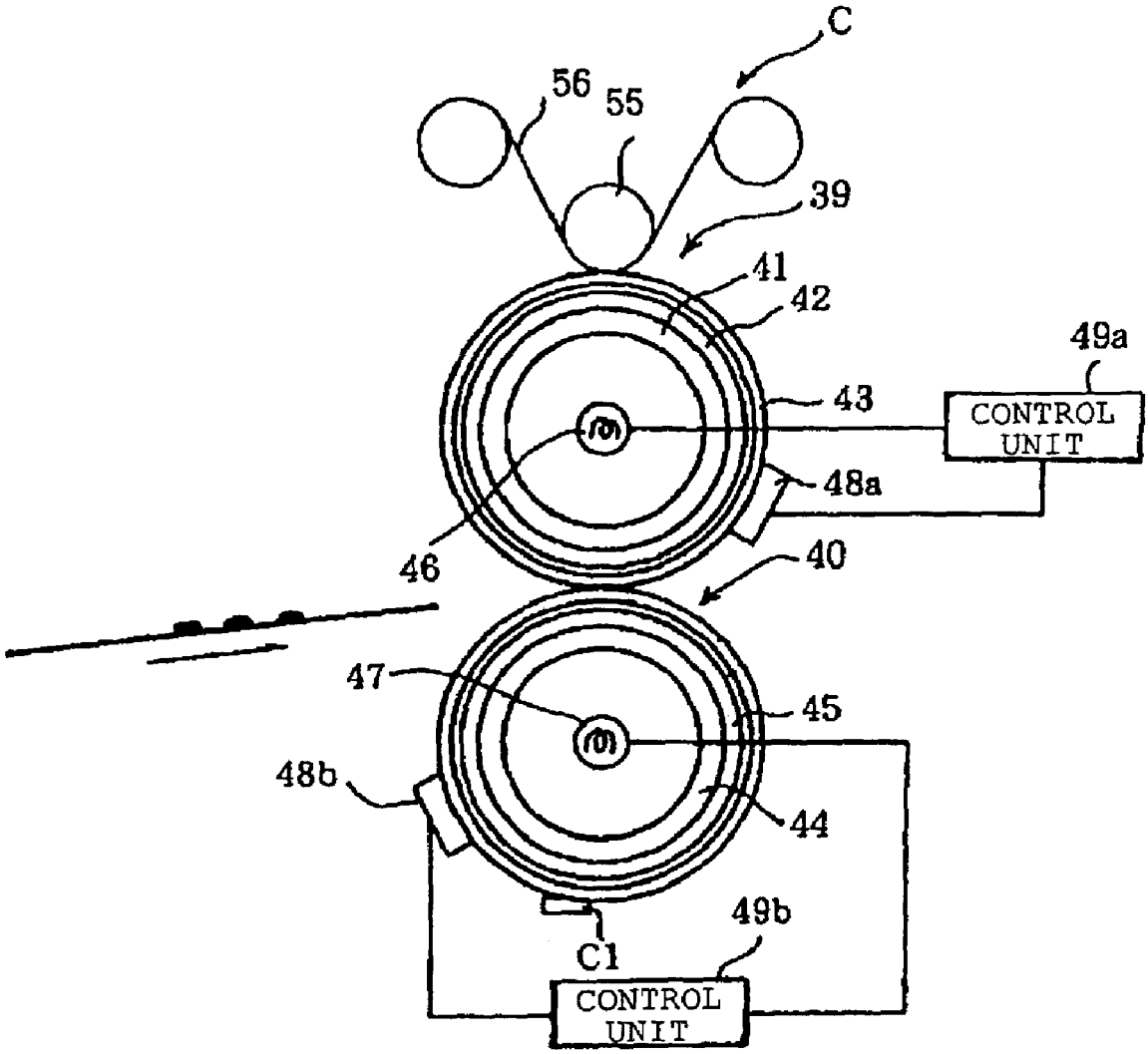
FIG. 2 is a schematically explanatory view showing one example of heating/pressurizing/fixing means.

In FIG. 2, a fixing roller 39 which is fixing means includes: for example, a 2 mm thick room temperature vulcanized type (RTV, JIS-A hardness 20) silicone rubber layer 42 on a 5 mm thick core metal 41 of aluminum; and a 50 μm thick polytetrafluoroethylene (PTFE layer) 43 outside the rubber layer.

On the other hand, a pressurizing roller 40 which is pressurizing means includes, for example, a 2 mm thick RTV silicone rubber layer 45 (rubber hardness JIS-A hardness 40) on a 5 mm thick core metal 44 of aluminum, and a 150 μm thick PTFE layer outside the rubber layer.

In FIG. 2, both the fixing roller and pressurizing roller have an outer diameter, for example, of 60 mm, but the hardness of the pressurizing roller is relatively high. In a sheet discharge test by blank sheets, a sheet discharge direction is disposed on the side of the pressurizing roller with respect to a line connecting center lines of both of the rollers. It is extremely important to dispose the sheet discharge direction on the side of the pressurizing roller in preventing a transfer material from being wound to the fixing roller during the fixing of a copy image having a large image area.

Examples of means for disposed the sheet discharge direction on the side of the pressurizing roller include: a method of making a hardness difference as described above; a method of setting the diameter of the pressurizing roller to be smaller than that of the fixing roller; and a method of setting a temperature on the side of the pressurizing roller to be higher than that of the fixing roller, evaporating more moisture of a fixing sheet rear surface, that is, the sheet surface on the side of the pressurizing roller, and accordingly using a remarkably small amount of shrinkage of paper.

Moreover, a halogen heater 46 which is heating means is disposed in the fixing roller 39, and a halogen heater 47 is similarly disposed in the core metal in the pressurizing roller 40 so that the opposite surfaces are heated. The temperatures of the fixing roller 39 and pressurizing roller 40 are detected by thermistors 48*a* and 48*b* which abut on the fixing roller 39 and pressurizing roller 40. The halogen heaters 46 and 47 are controlled by control devices 49*a* and 49*b* based on the detected temperatures. The temperatures of the fixing roller 39 and pressurizing roller 40 are both controlled to keep constant temperatures (e.g., 150±10° C.). The fixing roller 39 and pressurizing roller 40 are pressurized at a total pressure of 390 N (40 kgf) by a pressurizing mechanism (not shown).

In FIG. 2, C denotes a fixing roller cleaning device by an oil impregnated paper web, and C1 denotes a cleaning blade for removing oil and dirt sticking to the pressurizing roller. For the oil for impregnating the paper web, when 50 to 3000 cSt of silicone oil (silicone oils such as a dimethyl silicone oil and diphenyl silicone oil) is used, it is easy to constantly supply a small application amount of oil, and a grade of the fixed image (especially a uniform gloss property, oil trace) is high.

Moreover, when the oil is not applied, the cleaning device shown as C is removed, a paper or cloth web not impregnated with the oil is used, or a cleaning blade, pad, or roller may be used.

In the cleaning device C, a nonwoven fabric 56 is allowed to abut on the fixing roller 39 by a press roller 55 to clean the roller. The nonwoven fabric 56 is appropriately wound up by a wind-up device (not shown), and the toner is prevented from being deposited in an abutment portion to the fixing roller 39.

Since the toner of the present invention for use in the method for forming an image is superior in low-temperature fixing property and resistance to the high-temperature offset, it is possible to reduce the application amount of the above-mentioned oil, and a dirt amount of the cleaning device is also small.

The toner image of the toner of the present invention may be heated/pressurized/fixed on a temperature condition of a surface temperature of the fixing roller at 150 to 200° C. When the toner image is fixed onto the recording material, the application amount of the silicone oil supplied onto the fixing surface of the toner image of the recording material from the fixing member per unit area of the recording material is preferably 0 to $1\times10^{-7}$ g/cm$^2$. When the application amount exceeds $1\times10^{-7}$ g/cm$^2$, the recording material largely glistens, and especially visibility of a character image drops.

By the method for forming an image using the toner of the present invention, a superior full-color image can be formed on the recording material sheet.

<Process Cartridge>

A process cartridge of the present invention is constituted so as to be attachable/detachable with respect to the image forming apparatus. In the process cartridge, i) an image carrier or at least one means selected from the group consisting of the image carrier, a charging means for charging the image carrier, a latent image forming means for forming the electrostatic latent image on the image carrier, a transfer means for transferring a toner image formed by developing the electrostatic latent image onto a transfer material, and a cleaning means for removing toner remaining on the image carrier after the toner image is transferred onto the transfer material, and ii) a developing means for developing the electrostatic latent image formed on the image carrier with the toner to form the toner image are integrally supported. The toner satisfying the provisions of the present invention is used as the toner.

Figure 18:
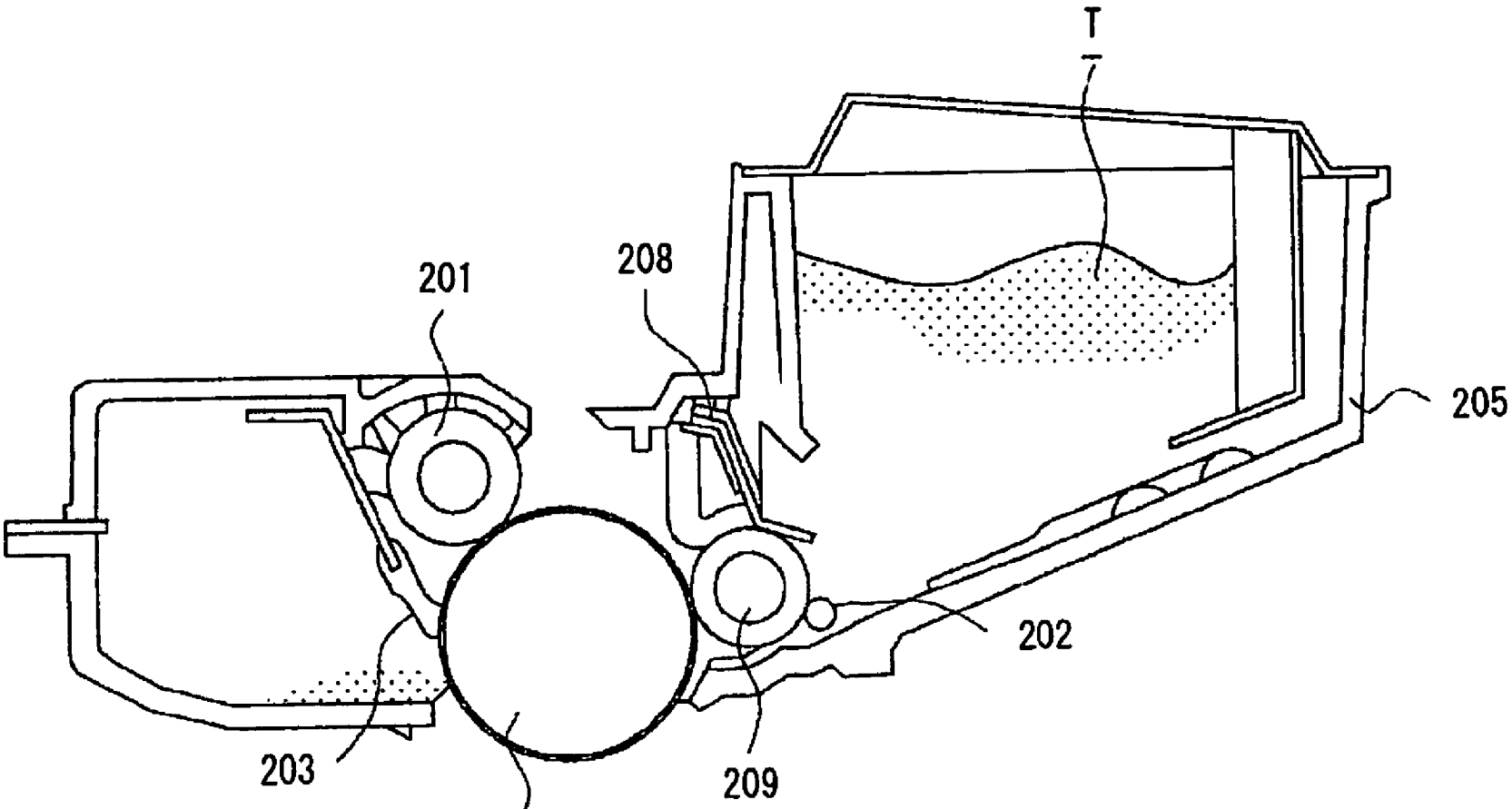
FIG. 18 is a diagram showing a constitution of one example of a process cartridge of the present invention.

FIG. 18 shows a schematically sectional view showing one concrete example of the process cartridge in which the developing device, the image carrier, the charging means, and the cleaning means are integrally supported. In the process cartridge shown in FIG. 18, a toner T is contained in the developing means 205, a developer carrier (developing roller) 209 is pressed and disposed against a photosensitive member 210 so that a nip portion is formed, and a coating blade 208 and a coating roller 202 are disposed so as to contact the developer carrier 209 with pressure. Furthermore, a charging roller 201 and a cleaning blade 203 are disposed to contact the photosensitive member 210 with pressure.

A method for measuring physical properties defined in the present invention will be described hereinafter.

(1) Acid Value Measurement of Toner and Binder Resin

The measurement is carried out in conformity with a method described in JIS K 0070.

Measuring device: Potential difference automatic titration device AT-400 (manufactured by Kyoto Denshi Co.)

Calibration of the device: A mixed solvent of 120 ml of toluene and 30 ml of ethanol is used.

Measurement temperature: 25° C.

Sample preparation: 1.0 g of the toner or 0.5 g of the binder resin is added to 120 ml of toluene, and stirred and dissolved using a magnetic stirrer at room temperature (about 25° C.) for about ten hours. Furthermore, 30 ml of ethanol is added to obtain a sample solution.

Measurement Operation:

1) 1.0 g of the sample is precisely weighed and brought into a 200 ml beaker. It is assumed that a weight of a soluble component of the sample is represented by W(g). 120 ml of toluene is added and stirred/dissolved. After stirring the sample for about ten hours, 30 ml of ethanol is added to obtain a mixed solution of toluene and ethanol. Additionally, a mixed solution containing only the same amount of toluene and ethanol is prepared beforehand for a blank test.

2) An ethanol solution of 0.1 mol/l of potassium hydroxide is used to carry out the blank test. It is assumed that the use amount of the potassium hydroxide solution at this time is represented by B(ml).

3) Next, the toner sample solution is titrated. It is assumed that the use amount of the potassium hydroxide solution at this time is S(ml).

4) The acid value is calculated by the following equation. f denotes a factor of KOH.

$$\text{Acid value } (mgKOH/g)=\{(S-B)\times f\times 5.61\}/W$$

(2) Measurement of Molecular Weight of THF Soluble Component

A column is stabilized in a heat chamber at 40° C., THF is passed as a solvent in the column at this temperature at a flow rate of 1 ml every minute, and about 100 μl of a THF sample solution is injected and measured. In the molecular weight measurement of the sample, a molecular weight distribution of the sample is calculated from a relation between a counted number and a logarithmic value of a working curve prepared by several types of mono-disperse polystyrene standard samples.

As a standard polystyrene sample for preparing the working curve, for example, a sample which is manufactured by Tosoh Corp. or Showa Denko K.K. and which has a molecular weight of about $10^2$ to $10^7$ is used, and the use of at least about ten standard polystyrene samples is appropriate. A refractive index (RI) detector is used in the detector.

It is to be noted that as the column, a plurality of polystyrene gel columns on the market may be combined. Examples of the column include: a combination of shodex GPC KF-801, 802, 803, 804, 805, 806, 807, 800P manufactured by Showa Denko K.K.; and a combination of TSK gel G1000H($H_{XL}$), G2000H($H_{XL}$), G3000H ($H_{XL}$), G4000H ($H_{XL}$), G5000H ($H_{XL}$), G6000H ($H_{XL}$), G7000H($H_{XL}$), and TSK guard column manufactured by Tosoh Corp.

The sample is prepared as follows.

The sample is brought into THF and left to stand for several hours. After sufficiently shaking the sample, the sample is well mixed with THF (until a coalescent material of the sample is eliminated), and further left at rest for 12 or more hours. An immersion time in THF at this time is set to 24 or more hours. Thereafter, the THF passed through a sample treatment filter (pore size of 0.2 to 0.5 μm, for example, Maishoridisuku H-25-2 manufactured by Tosoh Corp. can be used) is assumed as the sample of GPC. The sample concentration is adjusted to obtain a resin component of 0.5 to 5 mg/ml.

(3) Measurement of Tetrahydrofuran (THF) Insoluble Component 0.5 to 1.0 g of the toner sample whose THF insoluble component is to be measured is precisely weighed, brought into cylindrical filter paper (manufactured by Toyo Filter Paper Co., LTD., No. 86R, dimension is outer shape 28 mm× height 100 mm), and passed through a Soxhlet extractor, and 200 ml of THF which is an extracted solvent is used. In the extraction, an oil bath is controlled and used at a temperature of 120 to 130° C., and a time required for one reflow is adjusted to be in a range of 120 to 150 seconds. An extraction time is assumed to be ten hours. After end of the extraction, cylindrical filter paper is depressurized/dried at 70° C. for ten hours, and the THF insoluble component is calculated from the following equation.

$$THF \text{ insoluble component (mass \%)} = \frac{(W_1-(W_2+W_3))}{W_1-W_3}\times 100$$

wherein $W_1$ denotes the mass of the toner sample, $W_2$ denotes the mass of the THF soluble component of the binder resin, and $W_3$ denotes the mass of components other than the binder resin contained in the toner (e.g., a magnetic material, wax, outer addition agent, and the like).

(4) Measurement of Endothermic Peak Temperature of Wax

DSC-7 (manufactured by Perkin-Elmer Co., LTD.) which is a differential scanning calorimeter (DSC measurement apparatus) is used to measure the temperature in conformity with ASTM D3418–82.

5 mg of a measurement sample is precisely weighed and brought in an aluminum pan, an empty aluminum pan is used as a reference, and the measurement is carried out at a temperature rise speed of 10° C./minute in a temperature range of 30 to 200° C. In this temperature rise process, the temperature of a main peak of a DSC curve in a temperature range of 60 to 120° C. is regarded as the endothermic peak temperature of the wax.

(5) Measurement of Glass Transition Temperature (Tg) of Binder Resin

DSC-7 (manufactured by Perkin-Elmer Co., LTD.) which is a differential scanning calorimeter (DSC measurement apparatus) is used to measure the temperature in conformity with ASTM D3418-82.

5 mg of the measurement sample is precisely weighed and brought in the aluminum pan, the empty aluminum pan is used as the reference, and the measurement is carried out at the temperature rise speed of 10° C./minute in the temperature range of 30 to 200° C. In this temperature rise process, the endothermic peak of the main peak of the DSC curve in a temperature range of 40 to 100° C. is obtained. A base line is set before/after the endothermic peak, and an intersection of a line which passes a midpoint of the base line and the DSC curve is regarded as a glass transition temperature (Tg).

(6) Measurement of DSC Curve of Toner

The DSC curve in the temperature rise process of the toner is measured in the same manner as in the measurements of the endothermic peak temperature of the wax and the glass transition temperature of the binder resin. The endothermic peak temperature of the wax and the glass transition temperature (Tg) of the binder resin of the toner can also be known from the DSC curve.

(7) Measurement of Molecular Weight of Wax

A molecular weight distribution of the wax is measured by a gel permeation chromatography (GPC) on the following conditions.

GPC Measurement Conditions

Apparatus: GPC-150C (Waters Co., Ltd.)

Column: GMH-HT30 cm double strand (Toso Co., Ltd.)

Temperature: 135° C.

Solvent: o-dichlorobenzene (0.1% of IONOL (Shell in Japan Co.,Ltd) is added.)

Flow rate: 1.0 ml/min

Sample: 0.4 ml of the sample of 0.15 mass % is injected.

The molecular weight is measured on the above-described conditions. In calculation of the molecular weight of the sample, a molecular weight calibration curve prepared by the mono-disperse polystyrene standard sample is used. Furthermore, the molecular weight is calculated by polyethylene conversion with a conversion equation derived from Mark-Houwink viscosity formula.

The sample is prepared as follows.

The sample is brought into o-dichlorobenzene, a sample bin is heated on a hot plate set at 150° C., and the sample is dissolved. When the sample is molten, the sample is brought into a filter unit heated beforehand, and the sample is mounted in a main body. The sample passed through the filter unit is regarded as the GPC sample. The concentration of the sample is adjusted to be 0.15 mass %.

(8) Measurement of Particle Size Distribution of Toner

The average particle diameter and particle size distribution of the toner are measured using Coulter counter TA-II type (manufactured by Coulter Co., Ltd.), but Coulter multisizer (manufactured by Coulter Co., Ltd.) may also be used. For an electrolytic solution, first class sodium chloride is used to prepare an aqueous solution of 1% NaCl. For example, ISOTON R-II (manufactured by Coulter Scientific Japan Co., Ltd.) can be used.

In a measurement method, a surfactant, preferably alkyl benzene sulfonate is added as a dispersing agent by 0.1 to 0.5 ml into 100 to 150 ml of the electrolytic aqueous solution, and 2 to 20 mg of the measurement sample is further added. The electrolytic solution in which the sample is suspended is dispersed/treated by an ultrasonic dispersing device for about one to three minutes. By the measurement apparatus, a 100 μm aperture was used as an aperture, the volume and number of 2.00 μm or more toner were measured, and a volume distribution and number distribution were calculated. Subsequently, a weight-average particle diameter (D4) obtained from the volume distribution according to the present invention on a weight basis (a medium value of each channel is regarded as a representative value for each channel) was obtained.

For the channel, 13 channels are used: 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; and 32.00 to less than 40.30 μm.

(9) Measurement of Hydroxyl Value

The measurement is carried out in conformity with a measurement method described in JIS K 0070.

0.5 g of the sample is precisely weighed with a 100 ml measuring flask, and 5 ml of an acetylation reagent is added. Thereafter, the flask is immersed in a bath heated at 100°±5° C. After one to two hours, the flask is removed from the bath, and is left to cool. Thereafter, water is added and the flask is shaken to decompose an acetic anhydride. Furthermore, to complete the decomposition, the flask is again heated in the bath for ten or more minutes, and left to cool, and a wall of the flask is well washed in an organic solvent. A glass electrode is used to carry out a potential difference titration in a ½ mol of a potassium hydroxide ethyl alcohol solution so that a hydroxyl value is obtained.

(10) Measurement of Deformation Amount of Toner 5.0 to 5.5 g of toner is pressurized at a pressure of 400 kgf by a tablet molding unit for two minutes to mold the toner into a columnar sample having a diameter of 25 mm and a height of 10 to 11 mm. For the measurement apparatus, ARES (viscoelasticity measurement apparatus manufactured by Rheometric Co., Ltd.) is used, to which a parallel plate coated with 20 to 40 μm thick PTFE and formed of SUS and having a diameter of 25 mm is attached.

The toner molded sample is mounted on the parallel plate, and a jig temperature is controlled at 120° C. After confirming that the temperature of the sample reaches 120° C., a height (gap) of the sample is adjusted to 10.000 mm. A rate mode test is selected from multiple extension mode test, rate=−0.5 mm/s is set, the toner molded sample is compressed, and a relation between the height (gap) of the sample and a load required for compressing the sample at an equal speed (referred to as a normal force) is measured.

Assuming that the height (gap) of the sample at 200 g of the normal force is $G_{200}$ (mm), a deformation amount of the toner ($R_{200}$) can be calculated from the following equation.

$$R_{200} = \frac{10.000 - G_{200}}{10.000} \times 100$$

The height $G_{500}$ of the sample at the normal force of 500 g can be used to measure a deformation amount of the toner ($R_{500}$).

(11) Measurement of Mold Release Load of Toner

For the measurement apparatus, ARES (viscoelasticity measurement apparatus manufactured by Rheometric Co., Ltd.) used in measuring the deformation amount is used. For the sample, a molded columnar sample is used in the same manner as in the measurement of the deformation amount.

In the method for measuring the mold release load, the molded sample of the toner is mounted on the parallel plate coated with 20 to 40 μm thick PTFE and having a diameter of 25 mm, and the jig temperature is controlled at 120° C. After confirming that the temperature of the sample reaches 120° C., the height (gap) of the sample is adjusted to 10.000 mm. The rate mode test is selected from the multiple extension mode test, and the sample is compressed at a rate=−0.5 mm/s in zone 1 for ten seconds, and extended at a rate=+0.5 mm/s in zone 2 for 20 seconds. The relation between the height (gap) of the sample and the normal force (in this case, the force is the load required for extending the sample at the equal speed and represented by a minus value) is measured, and an absolute value of a minimum value of the normal force in the zone 2 is obtained as the mold release load of the toner.

(12) Measurement of Circularity of Toner Particles

The circularity of the toner particles can be measured using FPIA-1000 (manufactured by Toa Medical Electronics Co., Ltd.). Outline of the measurement is described in a catalog of FPIA-1000 issued by Toa Medical Electronics Co., Ltd. (version of June in 1995), an operation manual of the measurement apparatus, and the like. In a concrete measurement method, the surfactant, preferably alkyl benzene sulfonic acid sodium salt is added as the dispersing agent by 0.1 to 0.5 ml into 100 to 150 ml of water from which impurities have been removed, and about 0.1 to 0.5 g of the toner sample is added.

A suspension in which the sample is dispersed is irradiated with an ultrasonic wave (50 kHz, 120 W) for one to three minutes. The number of particles of the toner in the suspension is set to 12,000 to 20,000 particles/μl so that the concentration of the particles can be maintained so as to keep accuracy of the apparatus even with an increase of a cut ratio. The above-described flow type particle image measurement apparatus is used to measure a circularity distribution of particles having a circle equivalent diameter which is 0.60 μm or more and is less than 159.21 μm. Accordingly, the circularity can be obtained.

It is to be noted that for FPIA-1000, a calculation method is used. In the method, after calculating the circularity of each particle, in calculation of an average circularity and circularity standard deviation, the circularity of 0.4 to 1.0 is divided into 61 classes in accordance with the obtained circularity to classify the particles, and a center value and frequency of a dividing point are used to calculate the average circularity and circularity standard deviation.

However, an error between each value of the average circularity and circularity standard deviation calculated by the calculation method, and each value of the average circularity and circularity standard deviation calculated by a calculation equation directly using the circularity of each particle is very small, and is of a substantially ignorable extent. In the present invention, for reasons for treating data, such as reduction of a calculation time or simplification of a calculation equation, concept of the calculation equation directly using the circularity of each particle is used to partially change the calculation method, and such calculation method may also be used.

EXAMPLES

Concrete examples of the present invention will be described hereinafter, but the present invention is not limited to these examples.

Resin Manufacturing Example 1

In a reaction container including a reflux tube, stirrer, thermometer, nitrogen introduction tube, dropping device, and depressurization device, 90 parts by mass of a polyester monomer mixture containing: a carboxylic acid monomer (terephthalic acid: 30 mol %, isophthalic acid: 15 mol %, dodecenylsuccinic anhydride: 3 mol %); an alcohol monomer (a bisphenol A derivative represented by the following general formula (2) (R: an ethylene group, x+y=2.4): 26 mol % and a bisphenol A derivative represented by the general formula (2) (R: a propylene group, x+y=2.4): 26 mol %); and an esterification catalyst (dibutyltin oxide) was thrown in, and heated at 140° C. under a nitrogen atmosphere.

During the stirring, a vinyl-based monomer mixture containing: 8.5 parts by mass of styrene; 1.4 parts by mass of 2-ethylhexyl acrylate; 0.1 parts by mass of acrylic acid; and 0.1 parts by mass of di-t-butyl peroxide was dropped in two hours. Subsequently, under a reduced pressure, the mixture was heated at 210° C. to carry out dehydration condensation for eight hours, so that a hybrid resin (HB-1) was obtained.

(2)

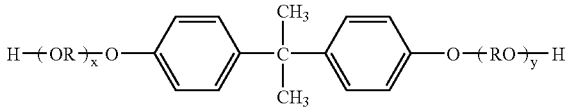

The obtained hybrid resin (HB-1) had a main peak in a molecular weight of 7200, had Mw/Mn of 13, glass transition temperature at 59° C., and acid value of 18 mgKOH/g, and contained 6 mass % of the THF insoluble component.

Resin Manufacturing Example 2

As the carboxylic acid monomer, terephthalic acid: 30 mol %, isophthalic acid: 12 mol %, fumaric acid: 3 mol %, dodecenylsuccinic anhydride: 3 mol % were used. As the alcohol monomer, the bisphenol A derivative represented by the above general formula (2) (R: ethylene group, x+y =2.4): 26 mol % and the bisphenol A derivative represented by the general formula (2) (R: propylene group, x+y =2.4): 26 mol % were used. Furthermore, as the esterification catalyst, dibutyltin oxide was used to carry out condensation polymerization. Accordingly, an unsaturated polyester resin composition (P-1) (acid value of 14 mgKOH/g, hydroxyl group value of 32 mgKOH/g, peak molecular weight of 7000, glass transition temperature at 58° C.) was obtained.

Subsequently, in the reaction container including the reflux tube, stirrer, thermometer, nitrogen introduction tube, dropping device, and depressurization device, 90 parts by mass of the unsaturated polyester resin composition (P-1) and 5 parts by mass of wax (W-1) were thrown in together with 200 parts by mass of xylene, and heated at 135° C. while nitrogen was introduced.

A monomer mixture containing: 8 parts by mass of styrene, 1.5 parts by mass of butyl acrylate, and 0.5 part by mass of monobutyl maleate forming a vinyl-based polymer unit; and 2 parts by mass of di-t-butyl peroxide as a polymerization initiator was added to the xylene solution to carry out radical polymerization for eight hours to obtain a solution mixture of polyester, the hybrid resin in which the vinyl-based polymer was grafted with unsaturated polyester, and the vinyl-based polymer.

Furthermore, under the reduced pressure, xylene was removed, reaction occurred between the hydroxyl group of the polyester resin unit and the carboxyl group of the vinyl-based polymer unit, and ester bond was generated. The resin composition obtained in this manner had the main peak in the molecular weight of 7500, Mw/Mn of 22, glass transition temperature at 62° C., and acid value of 21 mgKOH/g, and contained 9 mass % of the THF insoluble component. This was obtained as the hybrid resin composition (HB-2) of the present invention.

Resin Manufacturing Example 3

A hybrid resin composition (HB-3) was obtained in the same manner as in Resin Manufacturing Example 2 except that 70 parts by mass of the unsaturated polyester resin composition (P-1), 5 parts by mass of the wax (W-1), and further the monomer mixture containing 25 parts by mass of styrene, 4 parts by mass of butyl acrylate, and 1 part by mass of monobutyl maleate were used.

The resin composition had the main peak in a molecular weight of 7000, Mw/Mn of 34, glass transition temperature at 61° C., and acid value of 19 mgKOH/g, and contained 14 mass % of the THF insoluble component.

Resin Manufacturing Example 4

A hybrid resin composition (HB-4) was obtained in the same manner as in Resin Manufacturing Example 2 except that 50 parts by mass of the unsaturated polyester resin composition (P-1), 5 parts by mass of the wax (W-1), and further the monomer mixture containing 39 parts by mass of styrene, 8 parts by mass of butyl acrylate, and 3 parts by mass of monobutyl maleate were used.

The resin composition had the main peak in a molecular weight of 9300, Mw/Mn of 9, glass transition temperature at 63° C., and acid value of 15 mgKOH/g, and contained 21 mass % of the THF insoluble component.

Resin Manufacturing Example 5

A hybrid resin composition (HB-5) was obtained in the same manner as in Resin Manufacturing Example 2 except that a wax (W-2) was used instead of the wax (W-1).

Resin Manufacturing Example 6

A hybrid resin composition (HB-6) was obtained in the same manner as in Resin Manufacturing Example 2 except that a wax (W-3) was used instead of the wax (W-1).

Resin Manufacturing Example 7

In the reaction container including the reflux tube, stirrer, thermometer, nitrogen introduction tube, dropping device, and depressurization device, the polyester monomer mixture containing: the carboxylic acid monomer (terephthalic acid: 23 mol %, trimellitic acid: 6 mol %, dodecenylsuccinic anhydride: 20 mol %); the alcohol monomer (the bisphenol A derivative represented by the above general formula (2) (R: an ethylene group, x+y=2.4): 16 mol % and the bisphenol A derivative represented by the general formula (2) (R: propylene group, x+y=2.4): 35 mol %); and the esterification catalyst was thrown in, and heated at 210° C. under the nitrogen atmosphere during the depressurization. The dehydration and condensation were carried out for eight hours to obtain a polyester resin (P-2).

The resin composition had the main peak in a molecular weight of 7800, Mw/Mn of 7.4, glass transition temperature at 58° C., and acid value of 13 mgKOH/g, and contained 2 mass % of the THF insoluble component.

Physical properties of the wax used in the above-described resin manufacturing examples or the following examples are shown in Table 2.

TABLE 2

| | Type of wax | Endothermic peak temperature (° C.) | Peak molecular weight (–) | Mw/Mn (–) |
|---|---|---|---|---|
| Wax (W-1) | Paraffin wax | 79 | 550 | 1.3 |
| Wax (W-2) | Paraffin wax | 91 | 900 | 1.8 |
| Wax (W-3) | Polyethylene wax | 102 | 950 | 1.4 |
| Wax (W-4) | Polarity wax including hydroxyl group | 78 | 500 | 2.4 |
| Wax (W-5) | Low-molecular weight polypropylene wax | 137 | 8600 | 6.4 |

Example 1

| Toner 1 was prepared in the following method. | |
|---|---|
| Binder resin (HB-1) | 100 parts by mass |
| Wax (W-1) | 5 parts by mass |
| Pigment: copper phthalocyanine | 4 parts by mass |
| 3,5-di-tert-butyl salicylic acid aluminum compound | 0.5 part by mass |

A mixture of the above-described raw materials was molten/kneaded by a biaxial kneading extruder heated at 130° C. After the kneaded mixture was left to cool, the mixture was coarsely pulverized with a cutter mill to obtain a powder raw material (1) including 97 mass % of 18-mesh-pass and 92 mass % of 100-mesh-on.

Figure 3:
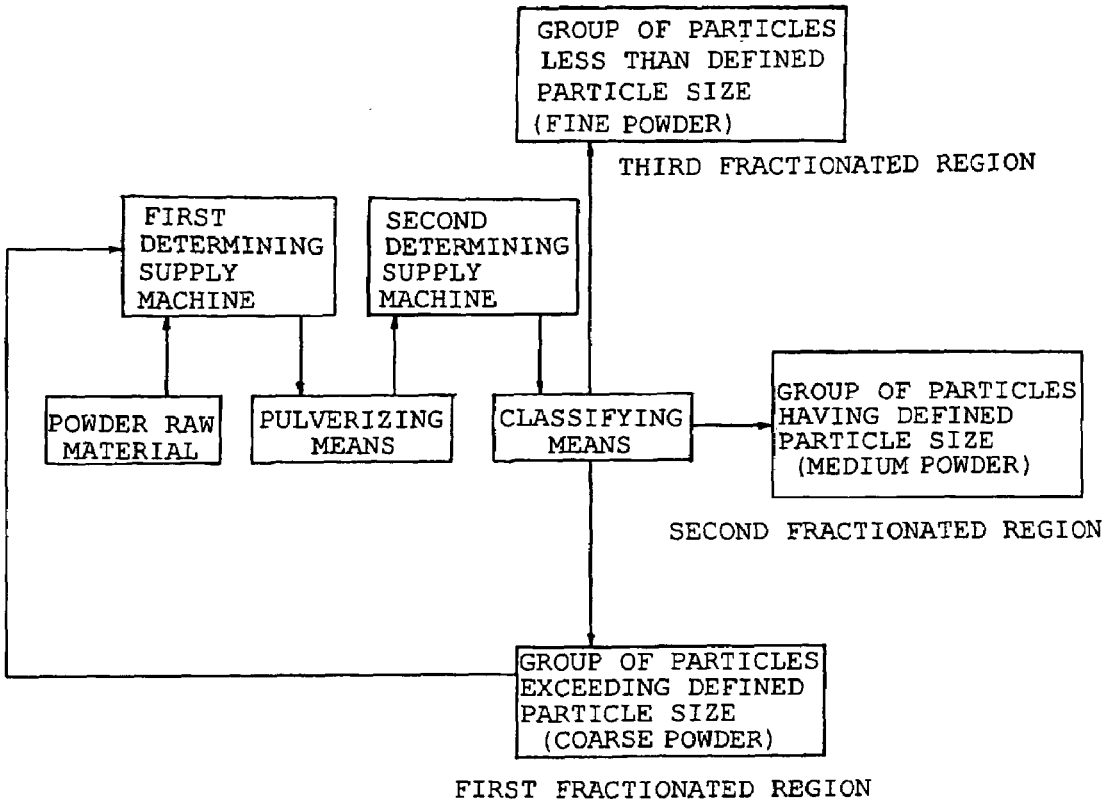
FIG. 3 is a flowchart showing a method for manufacturing the toner of the present invention.

The powder raw material (1) was pulverized and classified in accordance with a flowchart shown in FIG. 3 using an apparatus shown in FIG. 4. For the mechanical pulverizer 51, turbo mill T-250 type manufactured by Turbo Industries Co., Ltd. was used, a gap between the rotor 94 and stator 90 shown in FIG. 6 was set to 1.5 mm, and the rotor 94 was run at a peripheral speed of 115 m/s.

In the present example, the powder raw material including a coarsely pulverized material was supplied to the mechanical pulverizer 51 at a ratio of 40 kg/h by the table type first determining supply machine 52, and pulverized. The powder raw material pulverized by the mechanical pulverizer 51 was accompanied by suction air from an exhaust fan, trapped/collected by the cyclone 53, and introduced into the second determining supply machine 62. It is to be noted that at this time in the mechanical pulverizer 51, an inlet temperature was −10° C., an outlet temperature was 46° C., and ΔT between the inlet and outlet temperatures was 56° C.

Moreover, the finely pulverized material (1) pulverized by the mechanical pulverizer 51 at this time and obtained had a weight-average particle diameter of 5.3 μm, and had a sharp particle size distribution containing 59 number % of particles having a particle diameter of 4.0 μm or less and 2.3 volume % of particles having a particle diameter of 10.1 μm or more.

Next, the finely pulverized material (1) pulverized by the mechanical pulverizer 51 and obtained was introduced into the second determining supply machine 62, and introduced into the super fractionation air current type classifier 61 including the constitution of FIG. 8 at a ratio of 44 kg/h via the vibration feeder 63 and raw material supply nozzle 68.

The super fractionation air current type classifier 61 used the Coanda effect to classify the particles into three types of particles sizes of the coarse, medium, and fine powders. In the introduction of the material to be pulverized into the super fractionation air current type classifier 61, the air current in the raw material supply nozzle 68 generated by the depressurization inside the classifying chamber via at least one of the outlets 101 to 103, and the compressed air spouted from the high-pressure air supply nozzle 120 were used. The introduced finely pulverized material (1) was classified into three types of a coarse powder (G), medium powder (M-1), and fine powder momentarily in 0.1 second or less.

Among the classified powders, the coarse powder (G) was trapped/collected by the trapping/collecting cyclone 64*c*, subsequently introduced into the above-described mechanical pulverizer 51 at a ratio of 2.0 kg/h by the determining supply machine 54 of the coarse powder, and again introduced into the step of pulverizing.

The medium powder (M-1) classified in the above-described step of classifying had a weight-average particle diameter (D4) of 5.6 μm, and had a sharp particle size distribution containing 0.5 volume % of particles having a particle diameter of 10.1 μm or more. An average circularity was 0.963, and the particles having a circularity of 0.950 or more occupied 82.4% in accordance with accumulation on a number basis.

At this time, a classifying yield (ratio of the amount of the finally obtained medium powder to the total amount of the thrown-in powder raw material) was 86%.

With respect to 100 parts by mass of the medium powder (M-1), 1.0 part by mass of hydrophobic titanium oxide (BET specific surface area: 110 $m^2/g$) treated by n-$C_4H_9Si(OCH_3)_3$ was added to obtain a cyan toner (1). Furthermore, the cyan toner (1) and magnetic ferrite carrier particles (volume-average particle diameter of 50 μm) whose surface was coated with a silicone resin were mixed to obtain a toner concentration of 7 mass %, so that two-components-based cyan developer (1) was obtained.

Figure 14:
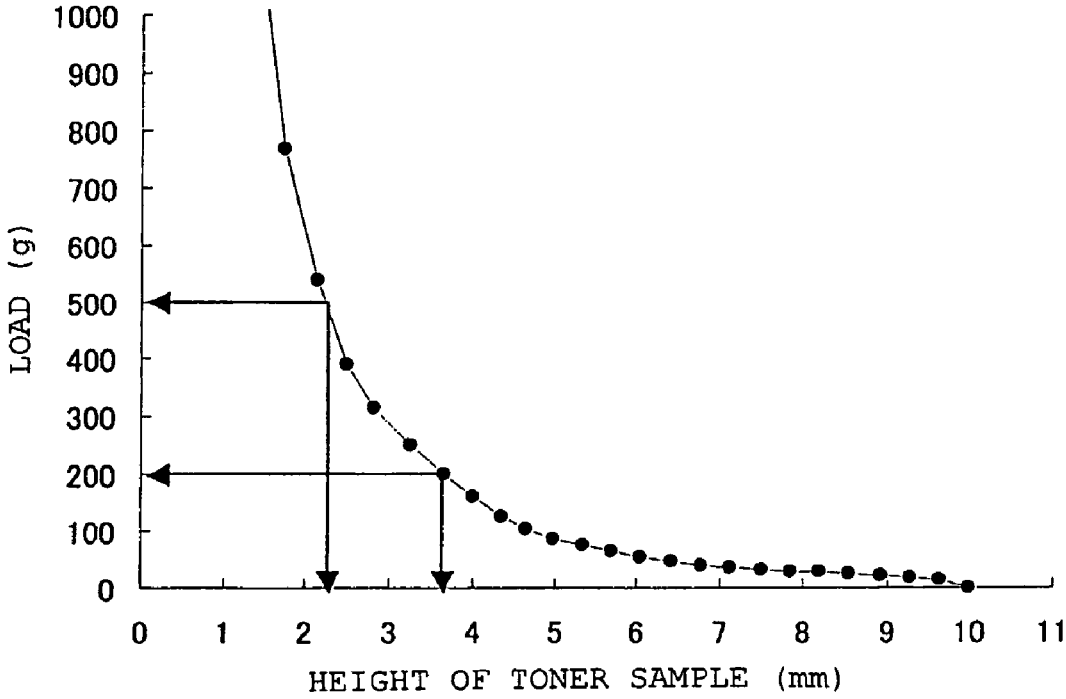
FIG. 14 is a diagram showing a relation between a load to toner (1) manufactured in Example 1 and a deformation amount of the toner.
Figure 16:
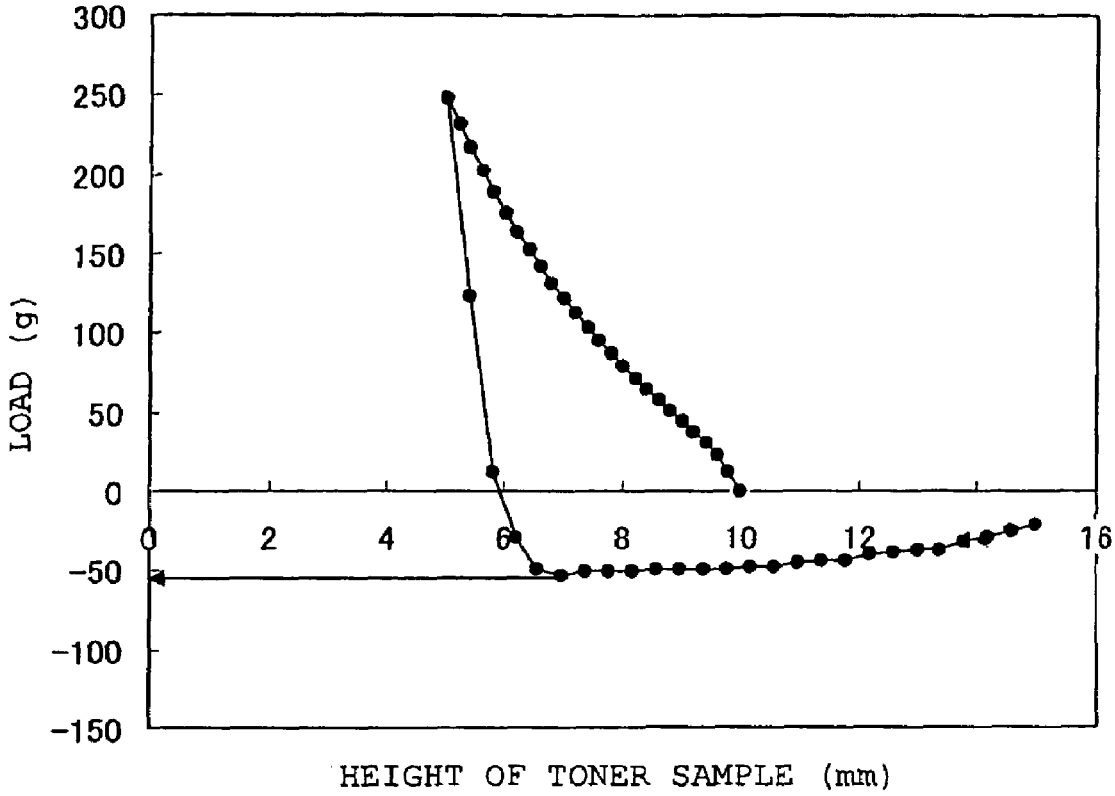
FIG. 16 is a diagram showing a mold release load of the toner (1) manufactured in Example 1.

The physical values of the cyan toner (1) are shown in Table 3. A diagram showing a relation between the load and toner deformation amount in the cyan toner (1) is shown in FIG. 14, and a diagram showing a mold release load of the cyan toner (1) is shown in FIG. 16.

This two-components-based cyan developer (1) was used to prepare an unfixed image in a monochromatic mode by a color copying machine CLC-800 (manufactured by Cannon Inc.). For the obtained unfixed image, a fixing device of a color printer LBP-2040 (manufactured by Cannon Inc.), that is, a thermal roll fixing device not including an oil coating device was used, a fixing temperature was changed, and a fixing speed was changed to 200 mm/sec to conduct a fixing test. An image area ratio at this time was 25%, and a laid amount of the toner per unit area was set to 0.7 mg/cm$^2$. Evaluation results are shown in Table 4.

It is to be noted that evaluation described in Table 4 was performed in accordance with the following standard.

(1) Evaluation of Fixable Temperature Region

For a fixing start temperature, gloss of the fixed image (projection angle, light receiving angle of 60°) was measured with a gloss meter (VG-10 type glossmeter, manufactured by Nihon Denshoku Co., Ltd.). The start temperature was set at a minimum temperature at which the fixed image having a gloss of 20% or more was obtained, and a hot offset generation temperature was set at a minimum temperature at which winding onto the fixing roller occurred.

(2) Pressurizing Roller Dirt (Back Dirt of Fixing Paper)

In the evaluation of dirt on the pressurizing roller, the fixing temperature was set at 220° C., 100 sheets of images were passed under a normal temperature/humidity (23.5° C./50%) environment, the number of sheets of the fixing paper having the back dirt was checked, and ranking was carried out as follows.

Rank A: 0 to 3 sheets
Rank B: 4 to 6 sheets
Rank C: 7 to 9 sheets
Rank D: 10 to 20 sheets
Rank E: 21 sheets or more (3) OHP Permeability In the evaluation of OHP transparency, a solid image having a toner laid amount of 0.6 mg/cm$^2$ was formed on the OHP, the fixing speed was set to 50 mm/sec., and the image was fixed at a fixing temperature lower than the high-temperature offset start temperature by 10° C. Shimadzu self-recording spectrophotometer UV2200 (manufactured by Shimadzu Corp.) was used, transmittance of the OHP film alone was set to 100%, the transmittance of the obtained OHP image was measured, and the ranking was performed on the following standard. It is to be noted that for a measurement wavelength, the transmittance was measured in a maximum absorption wavelength of the cyan toner which was 550 nm.

Rank A: 85% or more
Rank B: 75 to 84%
Rank C: 65 to 74%
Rank D: 50 to 64%
Rank E: less than 50%

(4) Heat Resistance Test (Blocking Resistance Test)

For blocking resistance of the toner, 100 g of toner was brought in a 500 ml polyethylene cup and left to stand in an oven at 50° C. for ten days to evaluate the resistance. In the evaluation, a level of coalescence was visually judged.

Rank A: Any coalescence material is not seen and fluidity is very satisfactory.

Rank B: Any coalescence material is not seen.

Rank C: A few coalescence material is seen but the material soon loosens.

Rank D: The coalescence material loosens in a developer stirring device (ordinary).

Rank E: The coalescence material does not sufficiently loosen in the developer stirring device (slightly bad).

Examples 2 to 4

Cyan toners (2) to (4) of the present invention were obtained in the same manner as in Example 1 except that waxes (W-2) to (W-4) were used. The physical values of the cyan toners (2) to (4) are shown in Table 3.

Moreover, the cyan toners (2) to (4) were used to prepare two-components-based cyan developers (2) to (4), and the images were evaluated in the same manner as in Example 1. Evaluation results are shown in Table 4.

Example 5

| | |
|---|---|
| Binder resin (HB-2) | 105 parts by mass |
| Pigment: copper phthalocyanine | 4 parts by mass |

Cyan toner (5) of the present invention was obtained in the same manner except that above-described raw material mixture was used. The physical values of the cyan toner (5) are shown in Table 3.

Moreover, the cyan toner (5) was used to prepare two-components-based cyan developer (5), and the images were evaluated in the same manner as in Example 1. The evaluation results are shown in Table 4.

Examples 6 to 9

Cyan toners (6) to (9) of the present invention were obtained in the same manner as in Example 5 except that binder resins (HB-3) to (HB-6) were used. The physical values of the cyan toners (6) to (9) are shown in Table 3.

Moreover, the cyan toners (6) to (9) were used to prepare two-components-based cyan developers (6) to (9), and the images were evaluated in the same manner as in Example 1. The evaluation results are shown in Table 4.

Example 10

| | |
|---|---|
| Binder resin (HB-4) | 84 parts by mass |
| Polyester resin (P-2) | 20 parts by mass |
| Pigment: copper phthalocyanine | 4 parts by mass |

Cyan toner (10) of the present invention was obtained in the same manner that the above-described raw material mixture was used. The physical values of the cyan toner (10) are shown in Table 3.

Moreover, the cyan toner (10) was used to prepare two-components-based cyan developer (10), and the images were evaluated in the same manner as in Example 1. The evaluation results are shown in Table 4.

Comparative Example 1

| | |
|---|---|
| Hybrid resin (HB-1) | 100 parts by mass |
| Polarity wax including hydroxyl group (W-4) | 3 parts by mass |
| Paraffin wax (W-1) | 3 parts by mass |
| Pigment: copper phthalocyanine | 4 parts by mass |
| 3,5-di-tert-butyl salicylic acid aluminum compound | 6 parts by mass |

The mixture of the above-described raw materials was molten/kneaded by the biaxial kneading extruder heated at 130° C. After the kneaded mixture was left to cool, the mixture was coarsely pulverized with the cutter mill to obtain a powder raw material for comparison (R-1) including 97 mass % of 18-mesh-pass and 92 mass % of 100-mesh-on.

Figure 9:
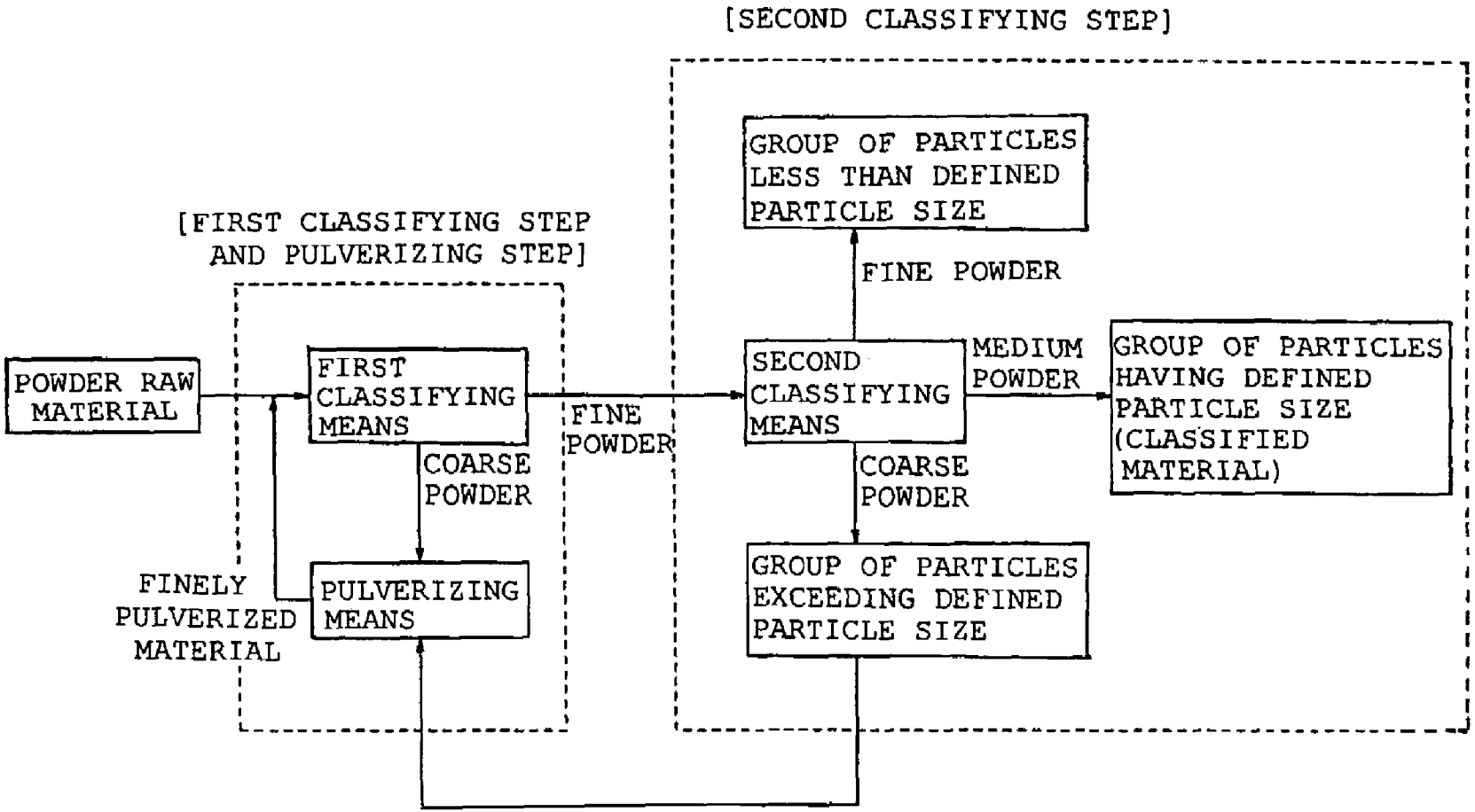
FIG. 9 is a flowchart showing a method for manufacturing a conventional toner.
Figure 10:
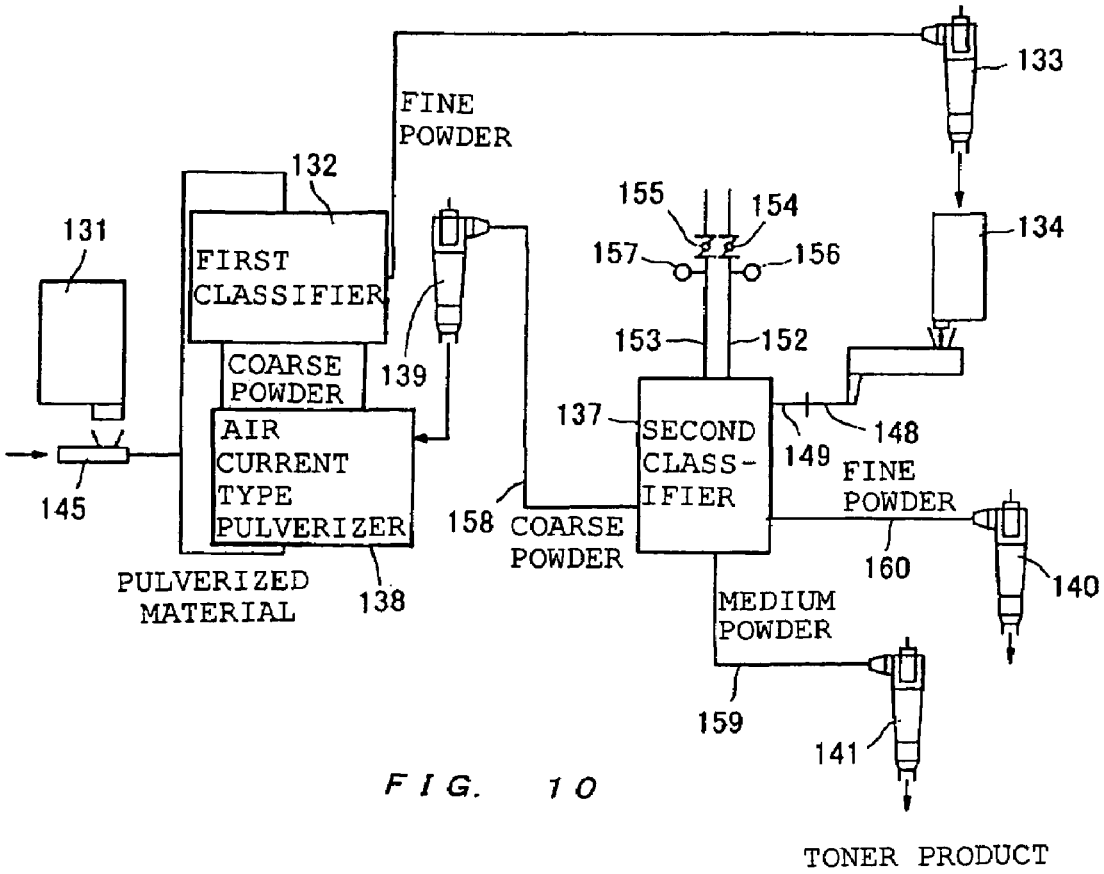
FIG. 10 is a diagram showing an apparatus system for carrying out the method for manufacturing the conventional toner.

The powder raw material for comparison (R-1) was pulverized and classified in accordance with a flowchart shown in FIG. 9 using an apparatus shown in FIG. 10. Additionally, for a collision type air current pulverizer 138, a pulverizer shown in FIG. 12 was used. For first classifying means (132 in FIG. 10), a classifier constituted as shown in FIG. 11 was used, and for second classifying means (137 in FIG. 10), a classifier constituted as shown in FIG. 13 was used.

It is to be noted that in FIG. 10: a reference numeral 131 denotes a determining supplier; 132 denotes a first classifier; 133 denotes a finely pulverized material trapping/collecting cyclone; 134 denotes a determining supplier; 137 denotes a super fractionation air current type classifier; 138 denotes an air current type pulverizer; 139 denotes a coarse powder trapping/collecting cyclone; 140 denotes a fine powder trapping/collecting cyclone; 141 denotes a medium powder trapping/collecting cyclone; 145 denotes a vibration feeder; 148 and 149 denote raw material supply tubes; 152 and 153 denote inflow tubes; 154 and 155 denote gas introduction adjustment means; 156 and 157 denote static pressure meters; and 158, 159, and 160 denote outlets.

Figure 11:
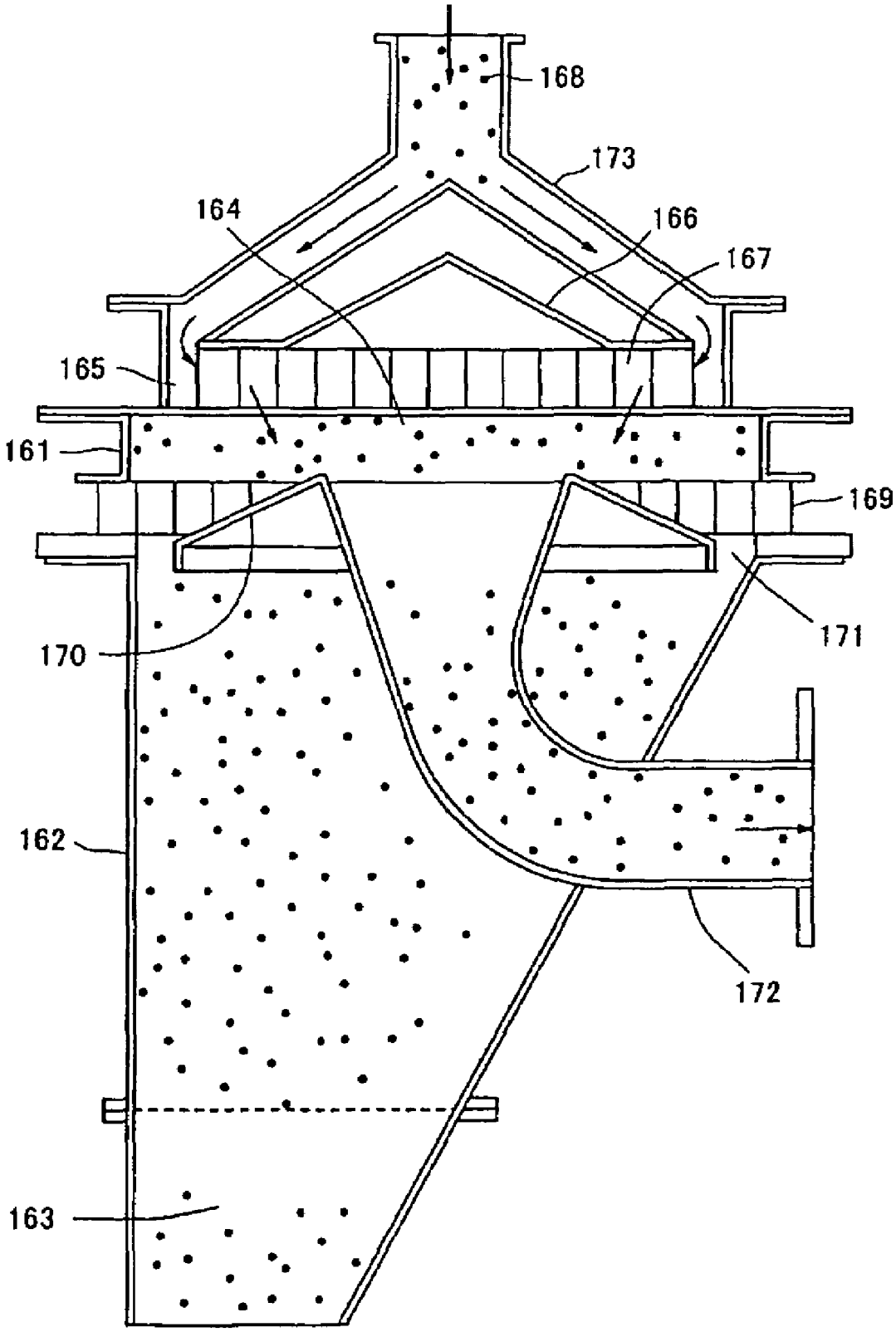
FIG. 11 is a schematically sectional view showing one example of a classifier for use in conventional first classifying means.

In FIG. 11: reference numeral 161 denotes a main body casing; 162 denotes a lower casing; 163 denotes a hopper for discharging coarse powder; 164 denotes a classifying chamber; 165 denotes a guide chamber; 166 denotes an upper cover; 167 denotes a louver; 168 denotes a supply cylinder; 169 denotes a classifying louver; 170 denotes a classifying plate; 171 denotes a coarse powder outlet; 172 denotes a fine powder discharge chute; and 173 denotes an upper casing.

Figure 12:
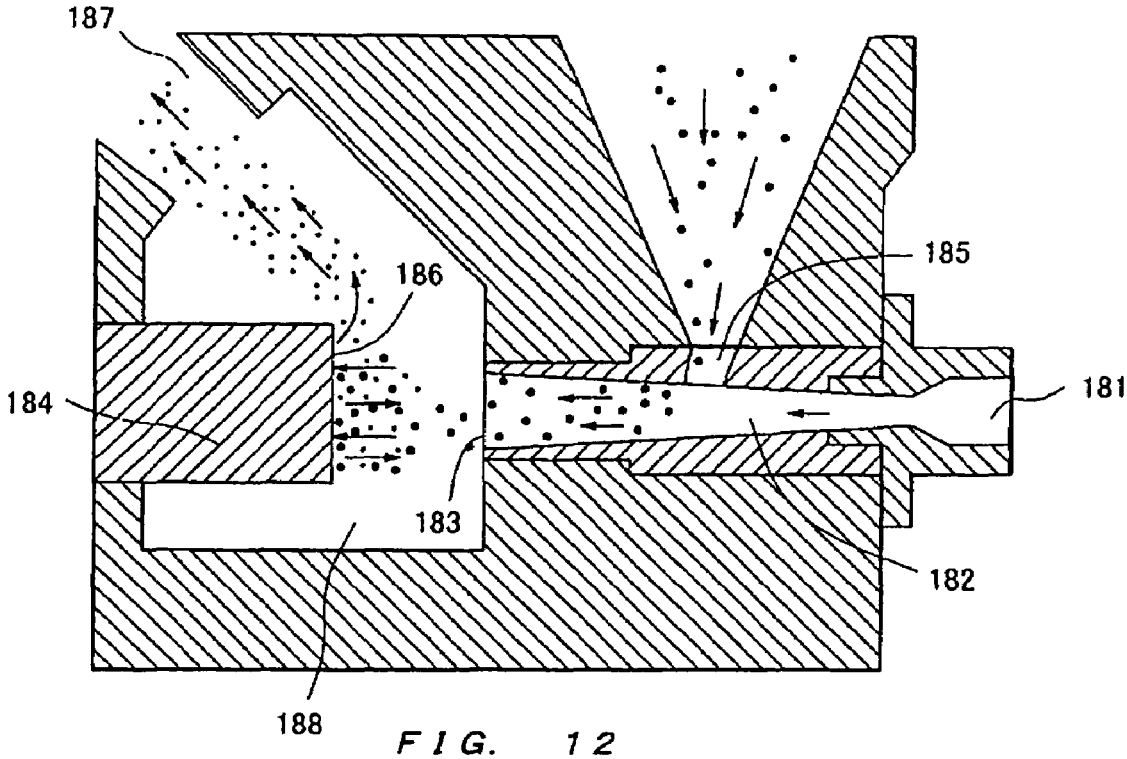
FIG. 12 is a schematically sectional view of a conventional collision type air current pulverizer.
Figure 13:
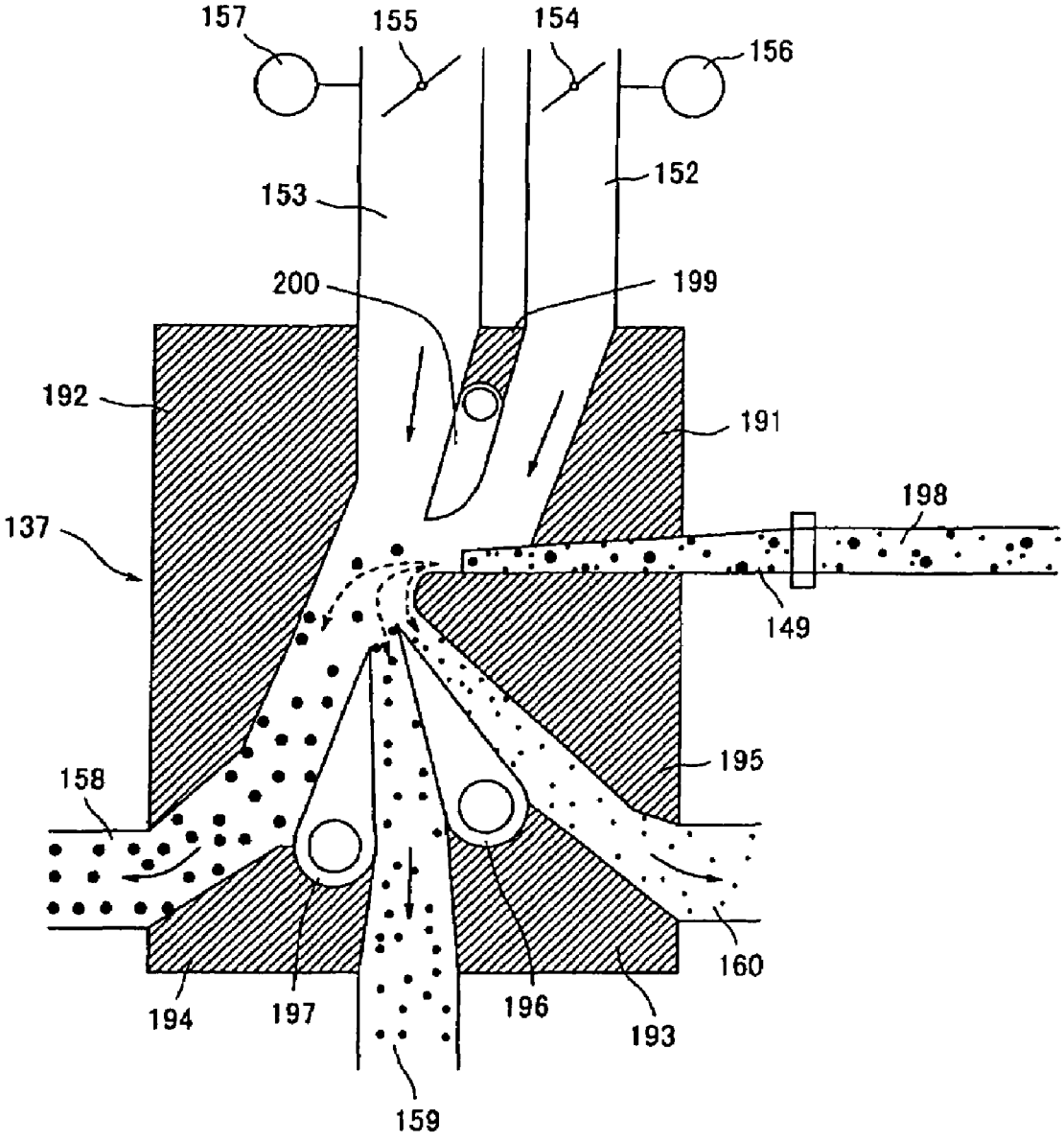
FIG. 13 is a schematically sectional view of the super fractionation air current type classifier for use in conventional second classifying means.

In FIG. 12: reference numeral 181 denotes a high-pressure gas supply nozzle; 182 denotes an acceleration tube; 183 denotes an outlet; 184 denotes a collision member; 186 denotes a collision surface; 185 denotes a powder raw material supply port; 187 denotes a pulverized material outlet; and 188 denotes a pulverizing chamber.

In FIG. 13: reference numeral 191 denotes a side wall; 192 denotes a G block; 193 and 194 denote classifying edge blocks; 195 denotes a Coanda block; 196 and 197 denote classifying edges; 198 denotes a raw material supply tube; 199 denotes a left block; and 200 denotes an inflow edge.

Moreover, in FIG. 13: reference numerals 152 and 153 denote inflow tubes; 154 and 155 denote gas introduction adjustment means; 156 and 157 denote static pressure meters; 158 denotes a coarse powder outlet; 159 denotes a medium powder outlet; and 160 denotes a fine powder outlet.

At this time, the finely pulverized material had a weight-average particle diameter of 7.1 μm and had a particle size distribution including 78.6 number % of particles having a particle diameter of 4.0 m or less and 13.7 volume % of particles having a diameter of 10.1 μm or more.

A medium powder for comparison RM-1 (classified material) classified in the above-described step of classifying had a weight-average particle diameter of 7.6 μm, contained 19 number % of particles having a particle diameter of 4.0 μm or less and 1.7 volume % of particles having a particle diameter of 10.1 μm or more, had an average circularity of 0.947, and contained 63.4 number % of particles having a circularity of 0.950 or more. It is to be noted that the classifying yield was 62%.

The cyan toner for comparison (1) was obtained in the same manner as in Example 1 except that the classified material for comparison RM-1 was used.

Figure 15:
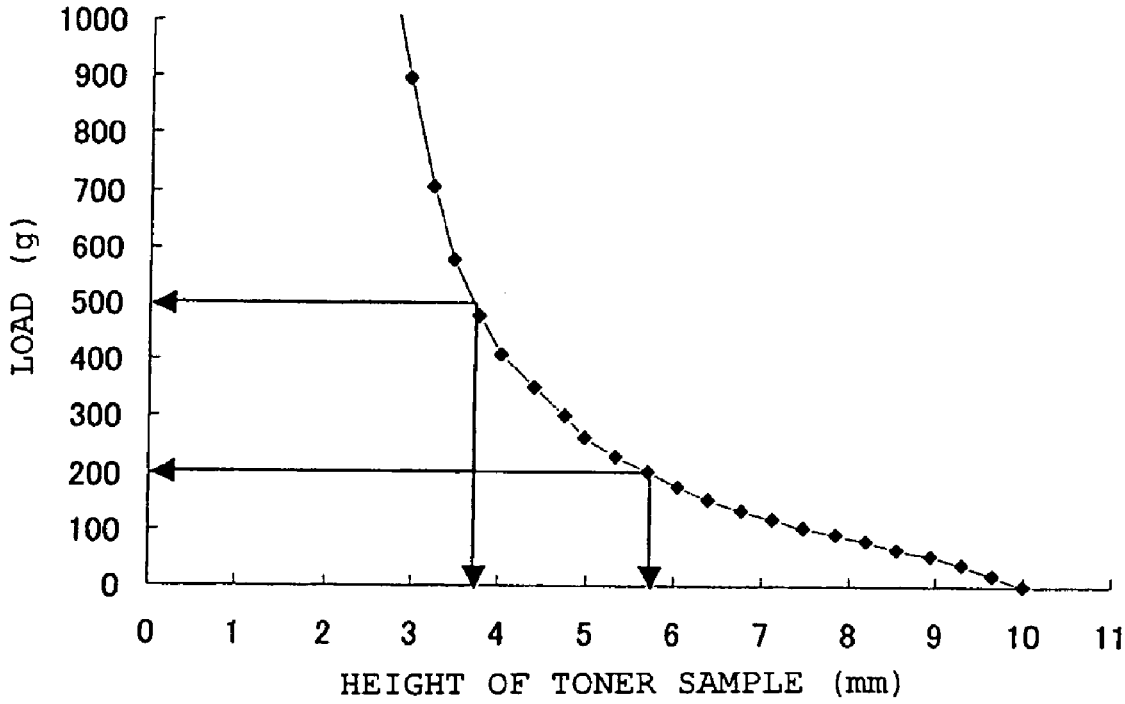
FIG. 15 is a diagram showing a relation between a load to toner (1) for comparison manufactured in Comparative Example 1 and a deformation amount of the toner.
Figure 17:
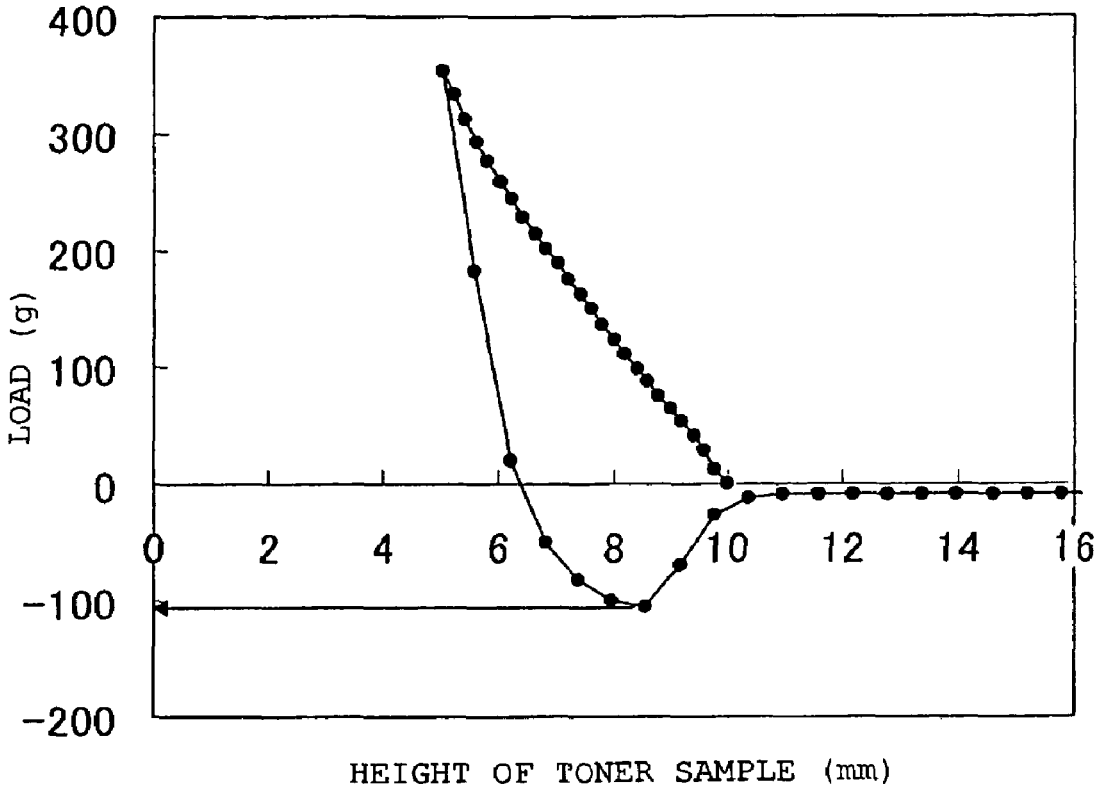
FIG. 17 is a diagram showing the mold release load of the toner (1) for comparison manufactured in Comparative Example 1.

The physical values of the cyan toner for comparison (1) are shown in Table 3. A diagram showing the relation between the load and the deformation amount of the toner in the cyan toner for comparison (1) is shown in FIG. 15, and a diagram showing the mold release load of the cyan toner for comparison (1) is shown in FIG. 17.

Moreover, the cyan toner for comparison (1) was used to prepare two-components-based cyan developer for comparison (1), and results of the evaluation performed in the same manner as in Example 1 are shown in Table 4.

Comparative Example 2

| | |
|---|---|
| Binder resin (P-2) | 100 parts by mass |
| Polyethylene wax (W-3) | 2 parts by mass |
| Pigment: copper phthalocyanine | 4 parts by mass |
| 3,5-di-tert-butyl salicylic acid zirconium compound | 4 parts by mass |

A classified material for comparison (R-2) was obtained in the same manner as in Comparative Example 1 except that the above-described raw material mixture was used. A cyan toner for comparison (2) was obtained in the same manner as in Example 1 except that the classified material for comparison (R-2) was used.

The physical values of the cyan toner for comparison (2) are shown in Table 3. The cyan toner for comparison (2) was used to prepare a two-components-based cyan developer for comparison (2), and the results of the evaluation performed in the same manner as in Example 1 are shown in Table 4.

Comparative Example 3

| | |
|---|---|
| Binder resin (P-2) | 100 parts by mass |
| Low-molecular-weight polypropylene (W-5) | 5 parts by mass |
| Pigment: copper phthalocyanine | 4 parts by mass |
| 3,5-di-tert-butyl salicylic acid aluminum compound | 0.5 part by mass |

A classified material for comparison (R-3) was obtained in the same manner as in Comparative Example 1 except that the above-described raw material mixture was used. A cyan toner for comparison (3) was obtained in the same manner as in Example 1 except that the classified material for comparison (R-3) was used.

The physical values of the cyan toner for comparison (3) are shown in Table 3. The cyan toner for comparison (3) was used to prepare a two-components-based cyan developer for comparison (3), and the results of the evaluation performed in the same manner as in Example 1 are shown in Table 4.

TABLE 3

| | Binder resin | Wax | Deformation amount of toner $R_{200}$ (%) | $R_{500}$ (%) | $R_{500}/R_{200}$ (–) | Mold release load of toner (g) | THF insoluble component (%) | Peak molecular weight (–) | Mw/Mn (–) | Average circularity (–) | Particle number having circularity of 0.950 or more (%) |
|---|---|---|---|---|---|---|---|---|---|---|---|
| Example 1 | HB-1 | W-1 | 66 | 78 | 1.18 | 53 | 8 | 7300 | 26 | 0.963 | 82.4 |
| Example 2 | HB-1 | W-2 | 61 | 75 | 1.23 | 67 | | The same as in Example 1 | | | |
| Example 3 | HB-1 | W-3 | 61 | 73 | 1.20 | 81 | | | | | |
| Example 4 | HB-1 | W-4 | 66 | 80 | 1.15 | 94 | | | | | |
| Example 5 | HB-2 | W-1 | 65 | 77 | 1.18 | 58 | 16 | 7600 | 88 | 0.956 | 80.2 |
| Example 6 | HB-3 | W-1 | 67 | 82 | 1.22 | 64 | 21 | 7900 | 59 | 0.955 | 79.8 |
| Example 7 | HB-4 | W-1 | 47 | 67 | 1.43 | 77 | 26 | 12600 | 14 | 0.954 | 79.8 |
| Example 8 | HB-5 | W-2 | 63 | 73 | 1.16 | 70 | | The same as in Example 5 | | | |
| Example 9 | HB-6 | W-3 | 54 | 71 | 1.31 | 91 | | | | | |
| Example 10 | HB-4 P-2 | W-1 | 71 | 83 | 1.17 | 49 | 13 | 10900 | 226 | 0.956 | 80.7 |
| Comparative Example 1 | HB-1 | W-1 | 42 | 64 | 1.52 | 105 | 53 | 7300 | 3650 | 0.944 | 64.5 |
| Comparative Example 2 | P-2 | W-3 | 41 | 63 | 1.54 | 233 | 56 | 8600 | 516 | 0.947 | 67.8 |
| Comparative Example 3 | P-2 | W-5 | 81 | 88 | 1.09 | 14 | 0 | 8800 | 3 | 0.945 | 66.2 |

TABLE 4

| | Evaluation of fixing capability of toner (fixing speed 300 mm/sec.) Fixing start temperature (° C.) | Hot offset generation temperature (° C.) | Fixable temperature region (° C.) | Dirt on pressurizing roller | Physical property evaluation of toner OHP permeability | Blocking test |
|---|---|---|---|---|---|---|
| Example 1 | 150 | 230 | 80 | Rank A | Rank A | Rank A |
| Example 2 | 160 | 230 | 70 | Rank A | Rank B | Rank A |
| Example 3 | 160 | 230 | 70 | Rank A | Rank B | Rank A |
| Example 4 | 150 | 200 | 50 | Rank B | Rank A | Rank B |
| Example 5 | 150 | 230 | 80 | Rank A | Rank A | Rank A |
| Example 6 | 150 | 220 | 70 | Rank A | Rank A | Rank A |
| Example 7 | 160 | 230 | 70 | Rank A | Rank B | Rank A |
| Example 8 | 160 | 230 | 70 | Rank A | Rank B | Rank A |
| Example 9 | 170 | 230 | 60 | Rank A | Rank B | Rank B |
| Example 10 | 150 | 220 | 70 | Rank A | Rank B | Rank B |
| Comparative Example 1 | 190 | >250 | — | Rank A | Rank D | Rank B |
| Comparative Example 2 | 190 | 210 | 20 | Rank E | Rank D | Rank C |
| Comparative Example 3 | 170 | 190 | 20 | Rank E | Rank B | Rank C |

Example 11

A yellow toner (1) was obtained in the same manner as in Example 1 except that 8 parts by mass of C.I. pigment yellow 180 was used as the pigment instead of copper phthalocyanine, a magenta toner (1) was obtained in the same manner except that 5 parts by mass of pigment red 122 was used, and further a black toner (1) was obtained in the same manner except that 5 parts by mass of carbon black was used. The physical properties of the obtained toner are shown in Table 5.

Furthermore, the magnetic ferrite carrier particles (volume-average particle diameter of 50 μm) whose surface was coated with the silicone resin were mixed with the obtained yellow toner (1), magenta toner (1), or black toner (1) to obtain a toner concentration of 7 mass %, so that a two-components-based yellow developer (1), two-components-based magenta developer (1), and two-components-based black developer (1) were obtained.

In Example 1, the two-components-based yellow developer (1) and two-components-based magenta developer (1), the two-components-based cyan developer (1) and two-components-based yellow developer (1), and the two-components-based cyan developer (1) and two-components-based magenta developer (1) were used, and the toner laid amount of each toner per unit area was set to seven stages to 1 mg/cm$^2$ from 0.4 mg/cm$^2$ every 0.1 mg/cm$^2$. Accordingly, unfixed images of red, green, and blue colors were prepared on a CLC color copy sheet, and OHP transparency sheet (manufactured by 3M Co., Ltd., overhead projector model 9550).

Subsequently, the fixing speed was set to 50 mm/sec, the fixing temperature was set to be lower than a high-temperature offset start temperature by 10° C., and the unfixed images obtained on the OHP transparency sheet were fixed. When the transparency and color mixture property of the fixed image were visually checked, any image had a very satisfactory transparency and was also superior in color mixture property.

Furthermore, the two-components-based cyan developer (1), two-components-based yellow developer (1), two-components-based magenta developer (1), and two-components-based black developer (1) were used to form a full-color image. In this case, the image superior in uniformity of gloss in the whole image was obtained.

Example 12

A cyan toner (11), yellow toner (2), magenta toner (2), and black toner (2) were obtained in the same manner as in the cyan toner (1) manufactured in Example 1 and the yellow toner (1), magenta toner (1), and black toner (1) manufactured in Example 11 except that the hydrophobic titanium oxide was changed to 1.5 parts by mass of hydrophobic dry type silica (BET specific surface area: 300 $m^2/g$) treated by hexamethyldisilazane and dimethylsilicone.

The above-described respective color toners were used to prepare an unfixed image only of the cyan color and to conduct the fixing test in the same manner as in Example 1 except that nonmagnetic one-component developing was carried out by a color printer LBP-2510 (manufactured by Cannon Inc.) to which the process cartridge structured as schematically shown in FIG. 18 was equiped. In the same manner as in Example 11, unfixed images of secondary colors such as red, green, and blue were prepared.

Subsequently, the fixing speed was set to 50 mm/sec, the fixing temperature was set to be lower than the high-temperature offset start temperature by 10° C., and the unfixed images obtained on the OHP transparency sheet were fixed. When the transparency and color mixture property of the fixed image were visually checked, any image had a very satisfactory transparency and was also superior in color mixture property.

Furthermore, the cyan toner (11), yellow toner (2), magenta toner (2), and black toner (2) were used to form the full-color image. In this case, the image superior in the uniformity of gloss in the whole image was obtained.

TABLE 5

| | Deformation amount of toner | | | Mold release | THF insoluble | Peak molecular | | Average | Particle number having circularity |
|---|---|---|---|---|---|---|---|---|---|
| | $R_{200}$ (%) | $R_{500}$ (%) | $R_{500}/R_{200}$ (–) | load of toner (g) | component (%) | weight (–) | Mw/Mn (–) | circularity (–) | of 0.950 or more (%) |
| Cyan toner (1) | 66 | 78 | 1.18 | 53 | 8 | 7300 | 26 | 0.963 | 82.4 |
| Yellow toner (1) | 68 | 78 | 1.15 | 53 | 8 | 7300 | 26 | 0.963 | 82.2 |
| Magenta toner (1) | 66 | 78 | 1.18 | 54 | 8 | 7300 | 26 | 0.961 | 82.1 |
| Black toner (1) | 66 | 78 | 1.18 | 53 | 8 | 7300 | 26 | 0.965 | 83.1 |
| Cyan toner (11) | 66 | 78 | 1.18 | 53 | 8 | 7300 | 26 | 0.962 | 82.2 |
| Yellow toner (2) | 67 | 78 | 1.16 | 54 | 8 | 7300 | 26 | 0.961 | 82.0 |
| Magenta toner (2) | 66 | 78 | 1.18 | 54 | 8 | 7300 | 26 | 0.963 | 82.4 |
| Black toner (2) | 66 | 78 | 1.18 | 53 | 8 | 7300 | 26 | 0.965 | 83.0 |

What is claimed is:

1. A non-magnetic toner comprising at least a binder resin, a coloring agent, and a wax, wherein:

(a) a deformation amount of the toner ($R_{200}$) at the time of application of a load of 200 g at a temperature of 120° C. is in a range of 45% to 75%;

(b) a deformation amount of the toner ($R_{500}$) at the time of application of a load of 500 g at a temperature of 120° C. is in a range of 65% to 85%;

(c) there is at least one endothermic peak or shoulder in a range at 60 to 120° C. in a DSC curve at the time of temperature rise measured by a differential scanning calorimeter (DSC); and (d) the coloring agent is present in amounts from 1 to 15 parts by mass based on 100 parts by mass of the binder resin.

2. The non-magnetic toner according to claim 1, wherein the deformation amount of the toner ($R_{200}$) is in a range of 50% to 70%.

3. The non-magnetic toner according to claim 1, wherein the deformation amount of the toner ($R_{200}$) is in a range of 55% to 67%.

4. The non-magnetic toner according to claim 1, wherein the deformation amount of the toner ($R_{500}$) is in a range of 70% to 83%.

5. The non-magnetic toner according to claim 1, wherein the deformation amount of the toner ($R_{500}$) is in a range of 75% to 80%.

6. The non-magnetic toner according to claim 1, wherein a ratio of the to $R_{200}$ to $R_{500}$ ($R_{500}/R_{200}$) is in a range of 1.10 to 1.50.

7. The non-magnetic toner according to claim 1, wherein a ratio of the $R_{200}$ to $R_{500}$ ($R_{501}R_{200}$) is in a range of 1.15 to 1.45.

8. The non-magnetic toner according to claim 1, wherein a ratio of the $R_{200}$ to $R_{500}$ ($R_{500}/R_{200}$) is in a range of 1.20 to 1.40.

9. The non-magnetic toner according to claim 1, wherein the toner indicates a mold release load of 20 to 100 g at the temperature of 120° C.

10. The non-magnetic toner according to claim 1, wherein the toner indicates a mold release load of 30 to 80 g at the temperature of 120° C.

11. The non-magnetic toner according to claim 1, wherein the toner indicates a mold release load of 40 to 70 g at the temperature of 120° C.

12. The non-magnetic toner according to claim 1, wherein the toner has at least one endothermic peak or shoulder in a range of temperature at 70 to 110° C. in the DSC curve at the time of temperature rise measured by the differential scanning calorimeter (DSC).

13. The non-magnetic toner according to claim 1, wherein the toner has at least one endothermic peak or shoulder in a range of temperature at 75 to 100° C. in the DSC curve at the time of temperature rise measured by the differential scanning calorimeter (DSC).

14. The non-magnetic toner according to claim 1, wherein the toner indicates a mold release load of 30 to 80 g at the temperature of 120° C., and the wax has at least one endothermic peak or shoulder in a range of temperature at 70 to 110° C. in the DSC curve at the time of temperature rise measured by the differential scanning calorimeter (DSC).

15. The non-magnetic toner according to claim 1, wherein the toner indicates a mold release load of 40 to 70 g at the temperature of 120° C., and the wax has at least one endothermic peak or shoulder in a range of temperature at 75 to 100° C. in the DSC curve at the time of temperature rise measured by the differential scanning calorimeter (DSC).

16. The non-magnetic toner according to claim 1, wherein the toner comprises 1 to 30 mass % of a tetrahydrofuran (THF) insoluble component in accordance with a total resin component basis.

17. The non-magnetic toner according to claim 1, wherein the toner comprises 2 to 25 mass % of a tetrahydrofuran (THF) insoluble component in accordance with a total resin component basis.

18. The non-magnetic toner according to claim 1, wherein the toner comprises 5 to 20 mass % of a tetrahydrofuran (THF) insoluble component in accordance with a total resin component basis.

19. The non-magnetic toner according to claim 1, wherein the toner is a color toner.

20. The non-magnetic toner according to claim 1, wherein the toner is a color toner selected from the group consisting of a cyan toner, a magenta toner, and a yellow toner.

21. A method for forming a full-color image comprising the steps of:

(i) forming a first static charge image on an image carrier, developing the static charge image with a first toner selected from the group consisting of a cyan toner, magenta toner, and yellow toner to form a first toner image on the image carrier, and transferring the first toner image onto a transfer material via or not via an intermediate transfer member;

(ii) forming a second static charge image on an image carrier, developing the static charge image with a second toner selected from the group consisting of the cyan toner, magenta toner, and yellow toner to form a second toner image on the image carrier, and transferring the second toner image onto the transfer material via or not via the intermediate transfer member;

(iii) forming a third static charge image on an image carrier, developing the static charge image with a third toner selected from the group consisting of the cyan toner, magenta toner, and yellow toner to form a third toner image on the image carrier, and transferring the third toner image onto the transfer material via or not via the intermediate transfer member;

(iv) heat-fixing the first to third toner images on the transfer material to form a full-color image on the transfer material; and (v) employing as the cyan toner, magenta toner, and yellow toner, a non-magnetic toner which comprises at least a binder resin, a coloring agent, and a wax and in which (a) a deformation amount of the toner ($R_{200}$) at the time of application of a load of 200 g at a temperature of 120° C. is in a range of 45% to 75% and in which (b) a deformation amount of the toner ($R_{500}$) at the time of application of a load of 500 g at a temperature of 120° C. is in a range of 65% to 85% and in which (c) there is at least one endothermic peak or shoulder in a range at 60 to 120° C. in a DSC curve at the time of temperature rise measured by a differential scanning calorimeter (DSC) and in which (d) the coloring agent is present in amounts from 1 to 15 parts by mass based on 100 parts by mass of the binder resin.

22. The method for forming a full-color image according to claim 21, wherein the method further comprises the steps of: forming a static charge image for black on an image carrier; developing the static charge image for black with a black toner to form a black toner image on the image carrier; transferring the black toner image onto the transfer material via or not via the intermediate transfer member; and heat-fixing the black toner image together with the first to third toner images on the transfer material to form a full-color image on the transfer material, wherein as the black toner, a non-magnetic toner is used which comprises at least a binder resin, a coloring agent, and a wax and in which (a) a deformation amount of the toner ($R_{200}$) at the time of application of a load of 200 g at a temperature of 120° C. is in a range of 45% to 75% and in which (b) a deformation amount of the toner ($R_{500}$) at the time of application of a load of 500 g at a temperature of 120° C. is in a range of 65% to 85% and in which (c) there is at least one endothermic peak or shoulder in a range at 60 to 120° C. in a DSC curve at the time of temperature rise measured by a differential scanning calorimeter (DSC) and in which (d) the coloring agent is present in amounts from 1 to 15 parts by mass based on 100 parts by mass of the binder resin.

23. The method for forming a full-color image according to claim 21, wherein any of the cyan toner, the magenta toner, and the yellow toner is the non-magnetic toner according to any one of claims 2 to 18.

24. The method for forming a full-color image according to claim 22, wherein any of the cyan toner, the magenta toner, the yellow toner, and the black toner is the non-magnetic toner according to any one of claims 2 to 18.

25. A process cartridge which is constituted so as to be attachable and detachable with respect to an image forming apparatus and in which i) an image carrier or at least one means selected from the group consisting of the image carrier, a charging means for charging the image carrier, a latent image forming means for forming an electrostatic latent image on the image carrier, a transfer means for transferring a toner image formed by developing the electrostatic latent image onto a transfer material, and a cleaning means for removing toner remaining on the image carrier after the toner image is transferred onto the transfer material, and ii) a developing means for developing the electrostatic latent image formed on the image carrier with the toner to form the toner images are integrally supported, wherein the toner is a non-magnetic toner which comprises at least a binder resin, a coloring agent, and a wax and in which (a) a deformation amount of the toner ($R_{200}$) at the time of application of a load of 200 g at a temperature of 120° C. is in a range of 45% to 75% and in which (b) a deformation amount of the toner ($R_{500}$) at the time of application of a load of 500 g at a temperature of 120° C. is in a range of 65% to 85% and in which (c) there is at least one endothermic peak or shoulder in a range at 60 to 120° C. in a DSC curve at the time of temperature rise measured by a differential scanning calorimeter (DSC) and in which (d) the coloring agent is present in amounts from 1 to 15 parts by mass based on 100 parts by mass of the binder resin.

26. The process cartridge according to claim 25, wherein the toner is the non-magnetic toner according to any one of claims 2 to 20.

* * * * *